US008315537B2

(12) United States Patent
Miyahara et al.

(10) Patent No.: US 8,315,537 B2
(45) Date of Patent: Nov. 20, 2012

(54) IMAGE-FORMING DEVICE HAVING CLEANING UNIT FOR REMOVING DEVELOPER

(75) Inventors: Kensuke Miyahara, Hekinan (JP); Hikaru Yoshizumi, Handa (JP); Susumu Sakuma, Kasugai (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 439 days.

(21) Appl. No.: 12/563,554

(22) Filed: Sep. 21, 2009

(65) Prior Publication Data

US 2010/0074646 A1 Mar. 25, 2010

(30) Foreign Application Priority Data

Sep. 25, 2008 (JP) ..... 2008-246455
Sep. 25, 2008 (JP) ..... 2008-246456

(51) Int. Cl.
*G03G 21/00* (2006.01)

(52) U.S. Cl. ..... 399/119

(58) Field of Classification Search ..... 399/119, 399/120, 302, 308, 312
See application file for complete search history.

(56) References Cited

U.S. PATENT DOCUMENTS

| | | | | |
|---|---|---|---|---|
| 5,250,997 | A | 10/1993 | Kaneko et al. | |
| 5,598,255 | A | 1/1997 | De Cock et al. | |
| 6,363,233 | B1 | 3/2002 | Nakajima | |
| 6,708,011 | B2 | 3/2004 | Nomura et al. | |
| 2001/0001025 | A1 | 5/2001 | Nakajima | |
| 2003/0138275 | A1 | 7/2003 | Yabuki et al. | |
| 2006/0216056 | A1 | 9/2006 | Okabe | |
| 2007/0048022 | A1 | 3/2007 | Inaba | |
| 2007/0217816 | A1 | 9/2007 | Shiraki | |
| 2007/0280730 | A1 | 12/2007 | Okabe et al. | |
| 2008/0019724 | A1 | 1/2008 | Yamagata | |
| 2009/0080947 | A1 * | 3/2009 | Suzuki et al. | 399/302 |
| 2009/0324284 | A1 * | 12/2009 | Ohta | 399/120 |

FOREIGN PATENT DOCUMENTS

| | | |
|---|---|---|
| JP | 04-215668 | 8/1992 |
| JP | 05-249866 | 9/1993 |
| JP | 06-003880 | 1/1994 |

(Continued)

OTHER PUBLICATIONS

Office Action for corresponding Japanese Application No. 2008-246455 mailed on Jul. 20, 2010.

(Continued)

*Primary Examiner* — Quana M Grainger
(74) *Attorney, Agent, or Firm* — Banner & Witcoff, Ltd.

(57) ABSTRACT

A plurality of photosensitive bodies is juxtaposed in a conveying direction, in which a recording medium is conveyed, with confronting the conveying unit. Each of a plurality of developing units is configured to move between a first position where the developing unit is capable of supplying developer to the corresponding photosensitive drum and a second position where the developing unit separates from the corresponding photosensitive drum. A cleaning member is configured to move between a third position where the cleaning member is capable of collecting a waste developer deposited on the conveying unit and a fourth position where the cleaning member separates from the conveying unit. A receptacle is slidably supported on one of the developing units and accommodates the collected waste developer. The cleaning member moves integrally with the receptacle. The receptacle and the one of the developing units are integrally detachably mounted on the main casing.

32 Claims, 9 Drawing Sheets

FOREIGN PATENT DOCUMENTS

| | | | | |
|---|---|---|---|---|
| JP | 07-333937 | | | 12/1995 |
| JP | 08292708 | A | * | 11/1996 |
| JP | 2000-181224 | | | 6/2000 |
| JP | 2002-006716 | | | 1/2002 |
| JP | 2003-015378 | | | 1/2003 |
| JP | 2003-215880 | | | 7/2003 |
| JP | 2003216006 | | | 7/2003 |
| JP | 2006-267890 | | | 10/2006 |
| JP | 2007-058073 | | | 3/2007 |
| JP | 2007-079445 | | | 3/2007 |
| JP | 2007-218936 | | | 8/2007 |
| JP | 2007-256352 | | | 10/2007 |
| JP | 2007-322554 | | | 12/2007 |
| JP | 2008-026560 | | | 2/2008 |

OTHER PUBLICATIONS

Office Action for corresponding Japanese Application No. 2008-246456 mailed on Jul. 27, 2010.

* cited by examiner

IMAGE-FORMING DEVICE HAVING CLEANING UNIT FOR REMOVING DEVELOPER

CROSS REFERENCE TO RELATED APPLICATION

This application claims priority from Japanese Patent Applications No. 2008-246455 filed Sep. 25, 2008 and No. 2008-246456 filed Sep. 25, 2008. The entire contents of the priority applications are incorporated herein by reference.

TECHNICAL FIELD

The present invention relates to an image-forming apparatus having an electrophotographic system or the like, and developing units provided in the image-forming apparatus.

BACKGROUND

A conventional color image-forming apparatus has a plurality of photosensitive members juxtaposed in a prescribed direction. Specifically, the conventional color image-forming apparatus has four photosensitive drums arranged parallel to each other and juxtaposed horizontally. Electrostatic latent images can be formed on the photosensitive drums. This image-forming apparatus also includes four developing units, each of which has a developing roller confronting the upper region of a corresponding photosensitive drum, and an endless paper-conveying belt disposed beneath the four photosensitive drums for conveying sheets of paper in a horizontal direction.

In this image-forming apparatus, the developing roller in each developing unit supplies toner to the surface of a corresponding photosensitive drum in order to develop the electrostatic latent image formed on the photosensitive drum into a visible toner image. Next, the toner images formed on the photosensitive drums are sequentially transferred to and superimposed on a sheet of paper conveyed on the paper-conveying belt to form a color image on the paper.

The color image-forming apparatus also has a cleaning unit for removing residual toner deposited on the paper-conveying belt. The cleaning unit includes a scraping blade disposed so as to contact the paper-conveying belt, and a cleaning box. Residual toner scraped off the paper-conveying belt by the scraping blade is collected in the cleaning box.

SUMMARY

When the cleaning box has collected the maximum amount of residual toner that can be accommodated therein, this cleaning box must be replaced with an empty cleaning box. The cleaning unit in the color image-forming apparatus described above has the cleaning box disposed beneath the paper-conveying belt. When performing maintenance on components inside the conventional image-forming apparatus, generally the operator accesses these components horizontally from a side or vertically from the top. However, in the image-forming apparatus described above, the paper-conveying belt, photosensitive drums, and developing units positioned above the cleaning unit must first be removed in order to replace the cleaning box, requiring considerable time and effort.

By providing the cleaning unit (or at least the cleaning box) on a developing unit, the cleaning box can be replaced when replacing the developing unit, without requiring the operator to remove the paper-conveying belt and photosensitive drums. However, in some color image-forming apparatuses, the developing units must be moved individually so that each developing roller can contact and separate from the corresponding photosensitive drum in order to form images of different types, such as monochrome images and color images. It may also be necessary to move the scraping blade in the cleaning unit so as to contact and separate from the paper-conveying belt in order that the blade does not interfere with the smooth conveyance of paper on the paper-conveying belt.

In such cases, when the cleaning unit is supported by a developing unit, the relative positions between the developing unit and scraping blade would be fixed. Hence, the developing unit and the scraping blade may not be able to move to their respective desired positions separately. Further, the members for moving the developing units and the members for moving the scraping blade must be provided separately, resulting in an increase in the number of components (i.e., an increase in cost).

In view of the foregoing, it is an object of the present invention to provide an image-forming apparatus having a receptacle supported on a developing unit for collecting developer removed from a conveying member by a cleaning member, the image-forming apparatus being capable of individually moving the developing units and the cleaning member to respective desired positions, while reducing the number of components.

This and other objects of the present invention will be attained by providing an image-forming apparatus including a main casing, a conveying unit, a plurality of photosensitive bodies, a plurality of developing units, a cleaning member, and a receptacle. The conveying unit conveys a recording medium in a conveying direction. The plurality of photosensitive bodies is juxtaposed in the conveying direction with confronting the conveying unit. The plurality of developing units is detachably mounted on the main casing. Each of the developing units is configured to move between a first position where the developing unit is capable of supplying developer to the corresponding photosensitive drum and a second position where the developing unit separates from the corresponding photosensitive drum. The cleaning member is configured to move between a third position where the cleaning member is capable of collecting a waste developer deposited on the conveying unit and a fourth position where the cleaning member separates from the conveying unit. The receptacle is slidably supported on one of the developing units and accommodates the collected waste developer collected by the cleaning member. The cleaning member moves integrally with the receptacle between the third position and the fourth position. The receptacle and the one of the developing units are integrally detachably mounted on the main casing.

In another aspect of the invention, there is provided a developing unit that is detachably mounted in a main casing of an image-forming apparatus. The image-forming apparatus includes a conveying unit that conveys a recording medium. The developing unit includes a developer casing, a developer carrying member that is supported on the developer casing, and a receptacle that is slidably supported on the developer casing and accommodates a waste developer collected from the conveying member.

In another aspect of the invention, there is provided an image-forming apparatus including a main casing, a conveying unit, a plurality of photosensitive bodies, a plurality of developing units, a cleaning member, a pair of first protrusions, a pair of second protrusions, and a pair of translation members. The conveying unit conveys a recording medium in a conveying direction. The plurality of photosensitive bodies is juxtaposed in the conveying direction with confronting the conveying unit. The plurality of developing units is detachably mounted on the main casing. Each of the developing units is configured to move between a first position where the developing unit is capable of supplying developer to the corresponding photosensitive drum and a second position where the developing unit separates from the corresponding photosensitive drum. The cleaning member is configured to move between a third position where the cleaning member is capable of collecting a waste developer deposited on the conveying unit and a fourth position where the cleaning member separates from the conveying unit. The pair of first protrusions is provided on each of the developing units and protrudes outward from both end portions of each developing unit in an axial direction of the photosensitive bodies, respectively. The pair of second protrusions extends in the axial direction. Each of the second protrusions is positioned on each side of the cleaning member in the axial direction. The positions of the second protrusions are fixed relative to the cleaning member. One first protrusion of the pair of first protrusions for each developing unit and one second protrusion of the pair of second protrusions are positioned one side in the axial direction and another first protrusion of the pair of first protrusions for each developing unit and another second protrusion of the pair of second protrusions are positioned another side in the axial direction. The pair of translation members is positioned both sides of the photosensitive bodies and the cleaning member in the axial direction, respectively, and is movable in the conveying direction. One translation member of the pair of translation members is engaged with the one first protrusions and the one second protrusion. Another translation member of the pair of translation members is engaged with the another first protrusions and the another second protrusion. The plurality of developing units is configured to move between the first position and the second position by the movement of the pair of translation members and the cleaning member is configured to move between the third position and the fourth position by the movement of the pair of translation members.

DETAILED DESCRIPTION

Figure 1:
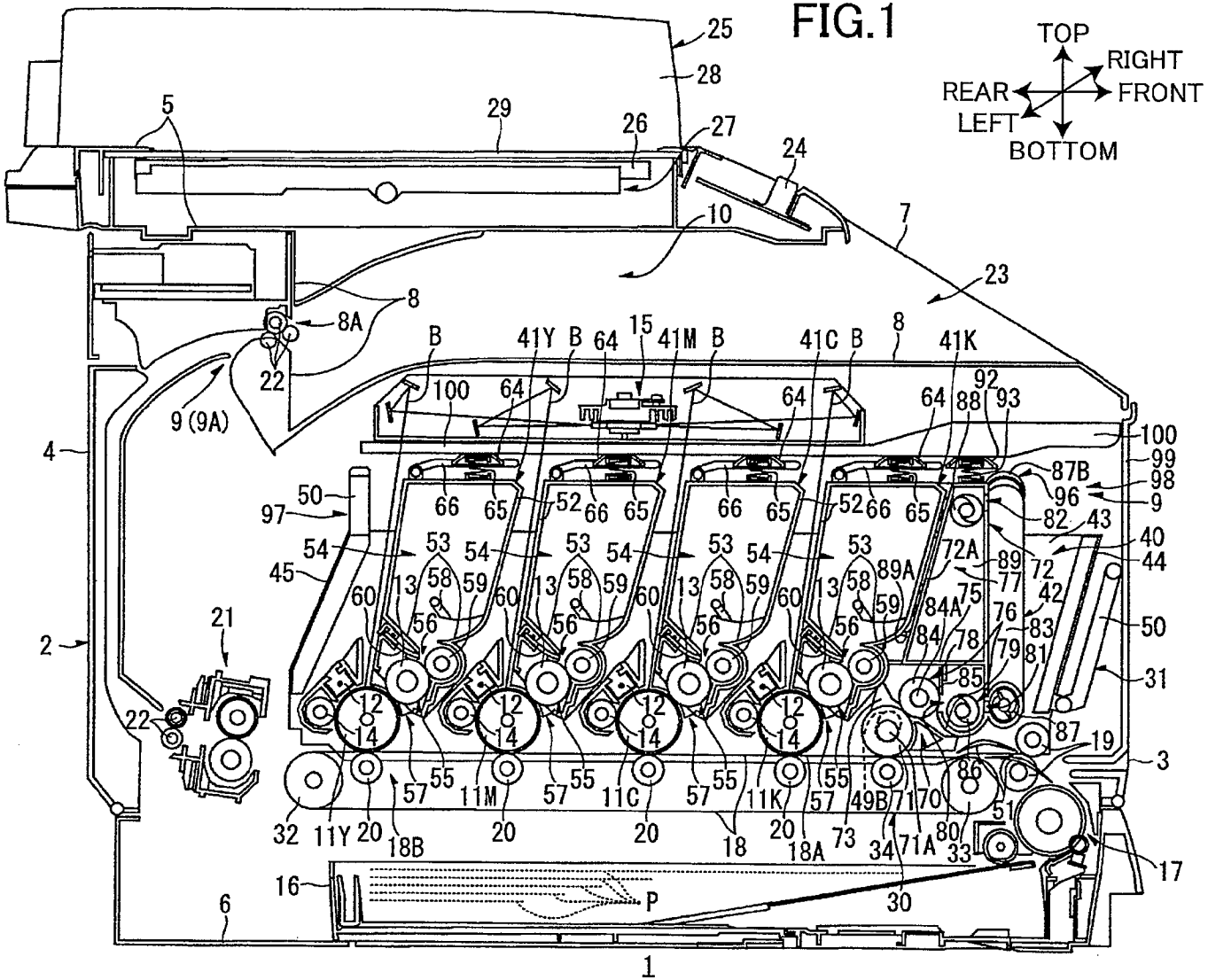
FIG. 1 is a left side cross-sectional view of a printer serving as an embodiment of an image-forming apparatus according to the present invention.

Next, an image-forming apparatus which is applied to a printer according to an embodiment of the present invention will be will be described with reference to the accompanying drawings.

1. Overall Structure of a Printer

In the following description, front and rear directions, up and down directions (corresponding to the height direction), and left and right directions (corresponding to the width direction) of the printer 1 will follow the directional arrows indicated in the drawings. Further, a substantially horizontal direction will include the front-to-rear direction and left-to-right direction, while a substantially vertical direction will include up and down directions in the following description.

As shown in FIG. 1, the printer 1 includes a main casing 2 functioning as a main body of the printer 1 that forms the outer shell thereof. The printer 1 further includes an image-reading unit 25, a feeding unit 17, a scanning unit 15, a process unit 31, a paper-conveying unit 30, a fixing unit 21, and a contacting/separating mechanism 110.

<Main Casing>

The main casing 2 has a substantially hollow parallelepiped shape. The outline of the main casing 2 is defined by a front wall 3 and a rear wall 4 extending in a substantially vertical direction, an upper wall (top wall) 5 and a lower wall (bottom wall) 6 extending in a substantially horizontal direction, and a sloped wall 7 extending at an upward and rearward slope from the top edge of the front wall 3 to the front edge of the upper wall 5. A pressing cover 28 of the image reading unit 25 described later is disposed on top of the upper wall 5.

A partitioning wall 8 is provided inside the main casing 2. The partitioning wall 8 is substantially L-shaped in a left side cross-sectional view, extends substantially horizontally from a point near the lower end of the sloped wall 7 to a point slightly forward of the rear wall 4, then extends vertically upward to connect with the upper wall 5. Just before angling upward to the upper wall 5, the partitioning wall 8 curves smoothly along a downward and rearward slope. A through-hole 8A is formed in this vertical section of the partitioning wall 8. The partitioning wall 8 partitions the interior of the main casing 2 into a lower space 9, and an upper space 10.

The lower space 9 is substantially L-shaped in a left side cross-sectional view and includes an upper rear region 9A formed on the rear side of the vertical section of the partitioning wall 8 connecting to the upper wall 5. The upper space 10 is positioned forward of the upper rear region 9A on the opposite side of the vertical section of the partitioning wall 8. The through-hole 8A allows communication between the lower space 9 (and specifically the upper rear region 9A) and the upper space 10.

A retrievable opening 23 in communication with the upper space 10 is formed in the sloped wall 7 of the main casing 2. The user can reach into the upper space 10 through the retrievable opening 23 to extract sheets of paper P discharged into the upper space 10. Operating keys 24 are provided on the top surface of the sloped wall 7 above the retrievable opening 23. By operating the operating keys 24, the user can control operations of the printer 1.

Figure 2:
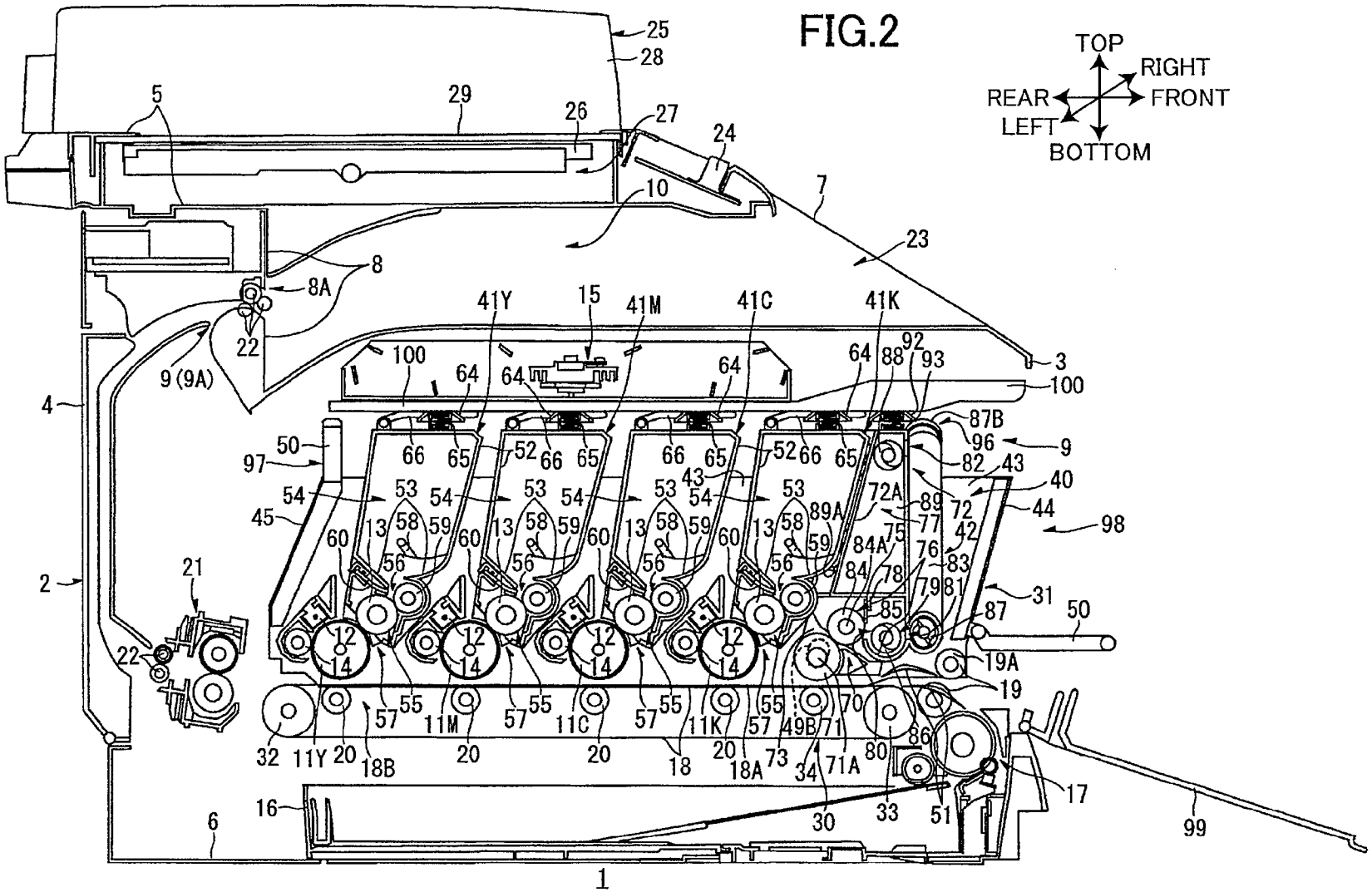
FIG. 2 shows a first state of the printer in FIG. 1 in which the process unit is being mounted in or removed from the main casing according to the embodiment.

An accommodating space 97 for accommodating the process unit 31 is allocated inside the main casing 2 in a region between the scanning unit 15 and the paper-conveying unit 30 (see also FIG. 2). A mounting opening 98 is formed in the front wall 3 of the main casing 2 and is in communication with the front side of the accommodating space 97. The mounting opening 98 allows the process unit 31 to be mounted in and removed from the accommodating space 97. A cover 99 is provided on the front wall 3. The cover 99 is capable of pivoting about a lower edge thereof between an erected orientation for covering the front side of the mounting opening 98 and a lowered orientation for exposing the front side of the mounting opening 98 (see FIGS. 2 and 3).

A pair of restraining rails 100 are provided in the main casing 2 at the top of the accommodating space 97 (bottom side of the scanning unit 15). The restraining rails 100 extend in the front-to-rear direction parallel to each other and are separated in the width direction. The front end of each restraining rail 100 is positioned near the mounting opening 98, while the rear end is positioned at the rear side of the accommodating space 97 (more specifically, a position near the rear end of the conveying belt 18 in the front-to-rear direction). The bottom edge of each restraining rail 100 is substantially horizontal from the rear end toward the mounting opening 98 on the front side, but near the mounting opening 98 slopes upward toward the front, extends again in a substantially horizontal direction, and finally curves upward at the forwardmost end.

<Image-Reading Unit>

The image-reading unit 25 is mounted on the upper wall 5 of the main casing 2 for reading image data from original documents. The image reading unit 25 includes a document base 27 embedded in the upper wall 5 so that the top surface is exposed and having a built-in CCD sensor 26, and the pressing cover 28 pivotably supported on the document base 27. The top surface of the document base 27 is configured of a glass plate 29. The pressing cover 28 has a pivoting shaft disposed on the rear end thereof in order to pivot between an open position (not shown) in which the glass plate 29 is exposed above and to the front side thereof, and a closed position (see FIG. 1) in which the top of the glass plate 29 is covered.

Pivoting the pressing cover 28 to the open position so that the glass plate 29 of the document base 27 is exposed allows the user to place a document on the glass plate 29. After setting the document, the user pivots the pressing cover 28 back to the closed position covering the glass plate 29 and performs an input operation on the operating keys 24 to begin scanning. At this time, the CCD sensor 26 of the document base 27 opposing the bottom surface of the document set on the glass plate 29 slides in the width direction to read image data from the document.

The printer 1 of this embodiment creates image data based on data scanned with the CCD sensor 26.

<Feeding Unit>

The feeding unit 17 is disposed in the lower section of the lower space 9 for accommodating sheets of paper P in a vertically stacked state. Various rollers are disposed near the front end of the paper cassette 16 for conveying the topmost sheet of paper P accommodated in the paper cassette 16 upward while the conveying direction is changed from a forward direction to a rearward direction. The various rollers in the feeding unit 17 include a pair of registration rollers 19 for conveying each sheet of paper P received from the paper cassette 16 toward a conveying belt 18 at a prescribed timing.

<Scanning Unit>

A scanning unit 15 is disposed in the upper section of the lower space 9 for irradiating laser beams B onto four photosensitive drums 11 (11K, 11C, 11M, and 11Y). The scanning unit 15 includes a laser light-emitting unit, a polygon mirror, and a plurality of lenses and reflecting mirrors. The laser light-emitting unit of the scanning unit 15 emits a laser beam for each of the colors cyan, magenta, yellow, and black. The laser beams B follow paths indicated by solid lines in FIG. 1 and are irradiated onto respective photosensitive drums 11 in the process unit 31.

<Process Unit>

The process unit 31 is disposed above the feeding unit 17 and beneath the scanning unit 15 and functions to form images on the sheets of paper P. The process unit 31 is detachably mounted in the main casing 2. The operation for mounting the process unit 31 in or removing the process unit 31 from the main casing 2 will be described later in greater detail.

The process unit 31 includes a process frame 40, four photosensitive drum 11, four Scorotron charger 12, four drum cleaner 14, four developer cartridges 41 (41Y, 41M, 41C, and 41K), and a cleaning unit 42. The process frame 40 integrally supports the photosensitive drums 11, the Scorotron charger 12, the drum cleaners 14, the developer cartridges 41, and a cleaning unit 42.

The four photosensitive drums 11 are rotatably supported on the process frame 40. The photosensitive drums 11 are parallel to each other and juxtaposed in the front-to-rear direction. The rotational axes (center axes) of the photosensitive drums 11 extend in the width direction. In the following description, the photosensitive drums 11 may be distinguished as a black photosensitive drum 11K, a cyan photosensitive drum 11C, a magenta photosensitive drum 11M, and a yellow photosensitive drum 11Y based on the color of toner images formed on the respective photosensitive drums 11. In the printer 1 of this embodiment, the black photosensitive drum 11K is positioned farthest on the front side among the four photosensitive drums 11.

The Scorotron charger 12, a developing roller 13, and the drum cleaner 14 are disposed in confrontation with each photosensitive drum 11. While the charger 12 is separated a prescribed gap from the photosensitive drum 11, the developing roller 13 and drum cleaner 14 are in contact with the peripheral surface of the photosensitive drum 11. Details of the process frame 40, the developer cartridges 41, and the cleaning unit 42 will be described later.

<Paper-Conveying Unit>

The paper-conveying unit 30 is disposed above the feeding unit 17 and beneath the four photosensitive drums 11 and functions to convey sheets of paper P. The registration rollers 19 described above are disposed in the lower space 9 in front of the paper-conveying unit 30, and the fixing unit 21 described above is disposed in the lower space 9 to the rear of the paper-conveying unit 30.

The paper-conveying unit 30 includes a conveying belt 18, transfer rollers 20, a drive roller 32, a follow roller 33, an auxiliary roller 34, and a frame (not shown) for rotatably supporting each of these rollers. The rotational axis (center axis) of each roller extends in the width direction. The drive roller 32 and follow roller 33 are arranged parallel to each other while separated in the front-to-rear direction, with the drive roller 32 positioned rearward of the follow roller 33.

The conveying belt 18 is an endless belt formed of polycarbonate or another resin material and has a greater width than the sheets of paper P. The conveying belt 18 is mounted over the drive roller 32 and follow roller 33, which pull the conveying belt 18 taut with a prescribed force. The top surface on the portion of the conveying belt 18 extending between the top of the drive roller 32 and the top of the follow roller 33 (hereinafter referred to as the "upper portion 18A") extends in a substantially horizontal plane. The four photosensitive drums 11 contact the top surface of the upper portion 18A of the conveying belt 18.

There are four of the transfer rollers 20 to correspond to the number of photosensitive drums 11. The transfer rollers 20 are disposed in an interior region 18B of the conveying belt 18. The transfer rollers 20 are arranged at intervals in the front-to-rear direction and oppose the bottoms of corresponding photosensitive drums 11 through the upper portion 18A of the conveying belt 18.

The auxiliary roller 34 is also disposed in the interior region 18B of the conveying belt 18 and contacts the bottom (inner) side of the upper portion 18A. The auxiliary roller 34 is parallel to the transfer rollers 20 and opposes the front side of the forwardmost transfer roller 20 while being separated therefrom. The function of the auxiliary roller 34 will be described below in greater detail.

<Fixing Unit>

The fixing unit 21 is disposed on the rear side of the conveying belt 18, and various rollers 22 are disposed between the fixing unit 21 and the through-hole 8A formed in the partitioning wall 8.

In the printer 1 as configured above, firstly, the photosensitive drums 11 are exposed to the laser beams B irradiated from the scanning unit 15 after the chargers 12 apply a uniform charge to the surfaces of the photosensitive drums 11. The scanning unit 15 irradiates the laser beams B based on image data in order to form electrostatic latent images on the surfaces of the photosensitive drums 11. Toner (developer) carried on the surface of the developing roller 13 corresponding to each photosensitive drum 11 develops the electrostatic latent image into a visible toner image of the corresponding color.

After the registration rollers 19 convey a sheet of paper P to the conveying belt 18, the conveying belt 18 conveys the sheet rearward so as to pass sequentially between each photosensitive drum 11 and corresponding transfer roller 20. A bias applied to the transfer rollers 20 transfers the toner images formed on the surfaces of the photosensitive drums 11 onto the sheet of paper P conveyed by the conveying belt 18 so that the toner images are sequentially superimposed. After transferring and superimposing toner images in all four colors, a color image is formed on the paper P.

In some cases, residual toner remains on the surfaces of the photosensitive drums 11 after the toner images have been transferred onto the paper P. Therefore, at this time, a bias is applied to the drum cleaners 14 for transferring this residual toner to the drum cleaners 14 (capturing the residual toner on the drum cleaners 14), thereby removing the toner from the photosensitive drums 11.

After a color image has been formed on the sheet of paper P, the conveying belt 18 conveys the sheet to the fixing unit 21 in the lower space 9. The fixing unit 21 fixes the toner images to the paper P with heat. Subsequently, the rollers 22 convey the sheet upward from the lower space 9 to the upper rear region 9A, while the conveying direction changes from a rearward direction to a forward direction, and subsequently discharges the sheet in a forward direction through the through-hole 8A of the partitioning wall 8 into the upper space 10.

During an image-forming operation, a motor (not shown) provided in the main casing 2 generates a drive force that is transferred to the drive roller 32 for rotating the same. As the drive roller 32 rotates, the conveying belt 18 moves circularly in a counterclockwise direction when viewed from the left side, while the follow roller 33 follows the movement of the conveying belt 18. Consequently, the upper portion 18A of the conveying belt 18 moves rearward in a substantially horizontal direction, and the transfer rollers 20 and auxiliary roller 34 disposed in the interior region 18B of the conveying belt 18 and contacting the bottom inner side of the upper portion 18A rotate counterclockwise in a left side view along with the movement of the upper portion 18A.

At this time, a sheet of paper P conveyed from the paper cassette 16 and transferred to the conveying belt 18 via the registration rollers 19 is placed on the upper portion 18A of the conveying belt 18. The upper portion 18A of the conveying belt 18 conveys the sheet of paper P rearward so that the sheet passes sequentially through the contact regions (transfer positions) between the photosensitive drums 11 and the upper portion 18A of the conveying belt 18. As described above, toner images formed on the surfaces of the photosensitive drums 11 are sequentially transferred onto and superimposed on the sheet of paper P. Accordingly, the conveying belt 18 conveys the sheet of paper P in the front-to-rear direction, and specifically a rearward direction along a substantially horizontal plane.

2. Process Unit

Next, the process unit 31 including the process frame 40, the developer cartridges 41, and the cleaning unit 42 will be described in detail.

(1) Process Frame

Figure 3:
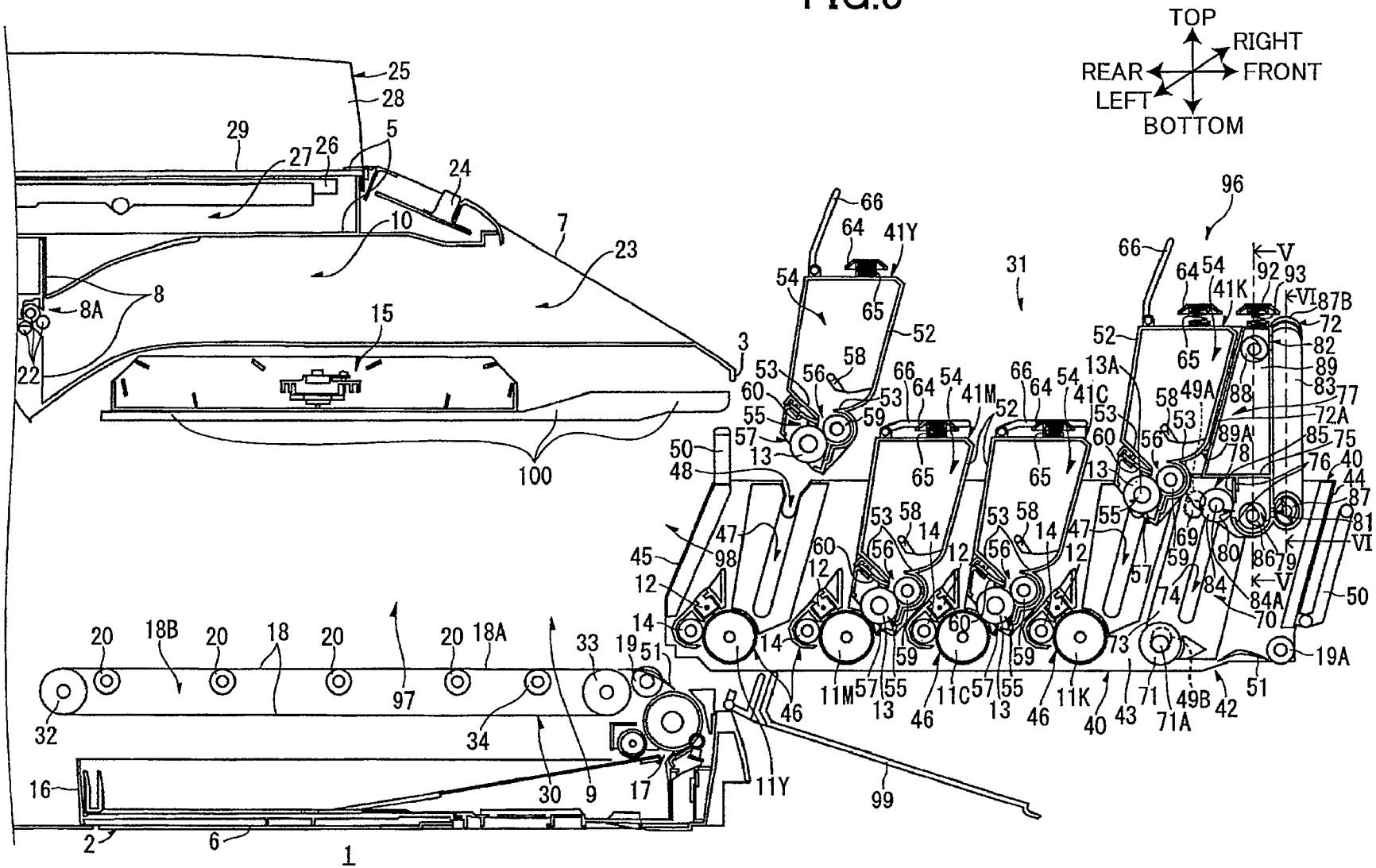
FIG. 3 shows a second state of the printer in FIG. 1 in which the process unit is being mounted in or removed from the main casing according to the embodiment.

As shown in FIG. 3, the process frame 40 has a hollow box shape elongated in the front-to-rear direction and is open on the upper and lower sides. The process frame 40 is movable in the front-to-rear direction relative to the main casing 2 and is capable of being pulled out of the main casing 2. The process frame 40 is integrally provided with a pair of side plates 43 arranged parallel to each other and separated in the width direction, a front plate 44 spanning between the front edges of the side plates 43, and a rear plate 45 spanning between the rear edges of the side plates 43. Only the right side plate 43 is indicated in FIG. 3.

The four photosensitive drums 11 described above span between the lower portions of the side plates 43 in the width direction and are juxtaposed in the front-to-rear direction. The widthwise ends of the photosensitive drums 11 are rotatably supported in the lower portions of the corresponding side plates 43. Hence, the side plates 43 support the photosensitive drums 11 within the process frame 40. In this state, the bottom peripheral surface of each photosensitive drum 11 is exposed through the opening in the bottom surface of the process frame 40.

The charger 12 and the drum cleaner 14 described above, which are disposed in confrontation with the photosensitive drum 11, also extend in the width direction so as to span between the pair of side plates 43. Each charger 12 opposes the corresponding photosensitive drum 11 from a position diagonally upward and rearward therefrom, and each drum cleaner 14 opposes and contacts the corresponding photosensitive drum 11 from the rear side at a position diagonally rearward and below the corresponding charger 12. The drum cleaner 14 is configured of a roller whose center axis extends in the width direction. Both widthwise ends of the drum cleaner 14 are rotatably supported in the corresponding side plates 43.

Part of the process unit 31 is formed when the photosensitive drums 11 and the corresponding chargers 12 and drum cleaners 14 are supported in the process frame 40 between the side plates 43. Here, a single photosensitive drum 11 and a charger 12 and drum cleaner 14 corresponding to the photosensitive drum 11 may be configured as an integral drum unit 46 (hence, the printer 1 would employ a total of four drum units 46), with each drum unit 46 being detachably mounted in the process frame 40.

First guide grooves 47 are formed in the inner surfaces (opposing surfaces) of the side plates 43 (the left side surface of the right side plate 43 shown in FIG. 3). A total of four first guide grooves 47 corresponding to the four photosensitive drums 11 are formed in each side plate 43. Each first guide groove 47 extends vertically (more specifically, upward along a slightly forward slope) along a straight line from a position above and forward of the corresponding photosensitive drum 11 to the top edge of the side plate 43. When viewed along the width direction, the width of the first guide groove 47 is constant along nearly the entire vertical length, but widens near the top end toward the upper edge of the side plate 43. The bottom end of the first guide groove 47 is rounded to form a substantially U-shape in the width direction. In the following description, an upward direction following a gradual forward slope will also be referred to as the "extending direction of the first guide grooves 47").

Only the top end of each first guide groove 47 penetrates the corresponding side plate 43 in the width direction. Specifically, when viewing the outside of the side plate 43 along the width direction, the top end of the side plate 43 is cut out to form substantially a U-shape (see FIGS. 8 through 10 described later). This substantially U-shaped portion will be referred to as a "cutout part 48".

Two guide holes 49 (49A and 49B) are formed in each side plate 43 so as to penetrate the side plate 43 in the width direction at positions a prescribed distance in front of the forwardmost first guide groove 47. The guide holes 49 are aligned in each side plate 43 along the extending direction of the first guide grooves 47 and are also elongated in the same direction. The upper guide hole 49 will be referred to as the upper guide hole 49A, and the lower guide hole 49 will be referred to as the lower guide hole 49B.

Both the front plate 44 and the rear plate 45 slope substantially along the extending direction of the first guide grooves 47. A handle 50 is integrally provided on each of the front surface of the front plate 44 and the top edge of the rear plate 45. The handle 50 provided on the front surface of the front plate 44 can pivot about the lower end thereof between an orientation following the front surface of the front plate 44 (see FIG. 1), and an orientation sloping forward from the front surface of the front plate 44 (see FIG. 2).

The pair of registration rollers 19 described earlier (see FIG. 1) includes an upper registration roller 19A that is rotatably supported in the process frame 40 between the pair of side plates 43 at a position beneath the front plate 44. One paper guide 51 is provided on the process frame 40 adjacent to the rear side of the upper registration roller 19A. The other paper guide 51 is also provided on the main casing 2. Together, these paper guides 51 guide sheets of paper P conveyed by the registration rollers 19 toward the conveying belt 18 (see FIG. 1).

(2) Developer Cartridges

As shown in FIG. 1, the four developer cartridges 41 are mounted in the process frame 40 in an arrangement juxtaposed in the front-to-rear direction. The four developer cartridges 41 are differentiated as a black developer cartridge 41K, a cyan developer cartridge 41C, a magenta developer cartridge 41M, and a yellow developer cartridge 41Y corresponding to the four colors of toner described above. The black developer cartridge 41K corresponds to the black photosensitive drum 11K, the cyan developer cartridge 41C to the cyan photosensitive drum 11C, the magenta developer cartridge 41M to the magenta photosensitive drum 11M, and the yellow developer cartridge 41Y to the yellow photosensitive drum 11Y.

The black developer cartridge 41K is positioned farthest forward of the four developer cartridges 41. Since the conveying belt 18 conveys sheets of paper P in a rearward direction substantially along the horizontal plane, as described above, the black developer cartridge 41K is positioned farthest upstream in the conveying direction of the paper P among the four developer cartridges 41.

Each developer cartridge 41 is detachably mounted in the process frame 40. Further, since the process unit 31 is detachably mounted in the main casing 2, as described above, each developer cartridge 41 detachably mounted in the process frame 40 of the process unit 31 is detachably mounted in the main casing 2. The operations for mounting the developer cartridges 41 in and removing the developer cartridges 41 from the process frame 40 (main casing 2) are described below.

FIG. 3 shows the state of the printer 1 when the rearmost yellow developer cartridge 41Y is completely removed from the process frame 40, and the forwardmost black developer cartridge 41K is in the process of being mounted in the process frame 40. The following description of the developer cartridges 41 primarily refers to the yellow developer cartridge 41Y in FIG. 3.

When a developer cartridge 41 is mounted in the process frame 40, the developer cartridge 41 is tilted slightly forward from the vertical along the extending direction of the first guide grooves 47 described above (see the developer cartridges 41C and 41M in FIG. 3). In FIG. 3, the black and yellow developer cartridges 41K and 41Y, which are not completely mounted in the process frame 40, are shown tilted in the same state as the cyan and magenta developer cartridges 41C and 41M that are currently mounted in the process frame 40. Hereinafter, the developer cartridges 41 will be described based on this tilted state.

Each developer cartridge 41 has a developer casing 52 serving as the outer shell thereof. The developer casing 52 has a hollow box shape that is elongated in the width direction. However, the width dimension of the developer casing 52 is smaller than the widthwise space between the left and right side plates 43 of the process frame 40. The top surface of the developer casing 52 is flat and substantially horizontal, while the front and rear surfaces are sloped substantially along the extending direction of the first guide grooves 47.

A partition 53 is provided vertically midway in the inside of the developer casing 52. The partition 53 partitions the interior of the developer casing 52 into a toner-accommodating chamber 54 in the upper section and a developing chamber 55 in the lower section. A communication opening 56 penetrates the partition 53 vertically to allow communication between the toner-accommodating chamber 54 and the developing chamber 55. An opening 57 is formed in the lower end of the developer casing 52. The opening 57 is in communication with the developing chamber 55 and allows communication between the developing chamber 55 and the exterior of the developer casing 52.

The toner-accommodating chamber 54 accommodates toner of the color corresponding to the developer cartridge 41. For example, the toner-accommodating chamber 54 of the yellow developer cartridge 41Y accommodates yellow toner. This toner is a nonmagnetic, single-component polymeric toner, which has excellent fluidity. Hence, the printer 1 employing this toner can form images of high quality. An agitator 58 is also provided in the toner-accommodating chamber 54. The agitator 58 is rotatably supported in the widthwise side walls of the developer casing 52.

Disposed in the developing chamber 55 are the developing roller 13 described earlier, a supply roller 59, and a thickness-regulating blade 60. The center axes of the developing roller 13 and supply roller 59 are aligned with the width direction. In other words, the axial direction of the developing roller 13 and the supply roller 59 is the width direction. Both the developing roller 13 and the supply roller 59 span between the widthwise side walls of the developer casing 52 and are rotatably supported in both side walls.

The supply roller 59 is disposed below the communication opening 56. The portion of the front surface of the developer casing 52 near the supply roller 59 is formed in a curve that is convex on the outer (front) side so as to follow the peripheral surface of the supply roller 59.

The developing roller 13 is disposed in contact with the supply roller 59 from a position diagonally rearward and below the supply roller 59. The bottom peripheral surface of the developing roller 13 is exposed through the opening 57. A bias is applied to the developing roller 13.

The thickness-regulating blade 60 is formed in a plate shape and extends along the width direction. The base edge (rear edge) of the thickness-regulating blade 60 is fixed to the rear wall of the developer casing 52, while the distal edge (front edge) contacts the top peripheral surface of the developing roller 13 with pressure.

Figure 4:
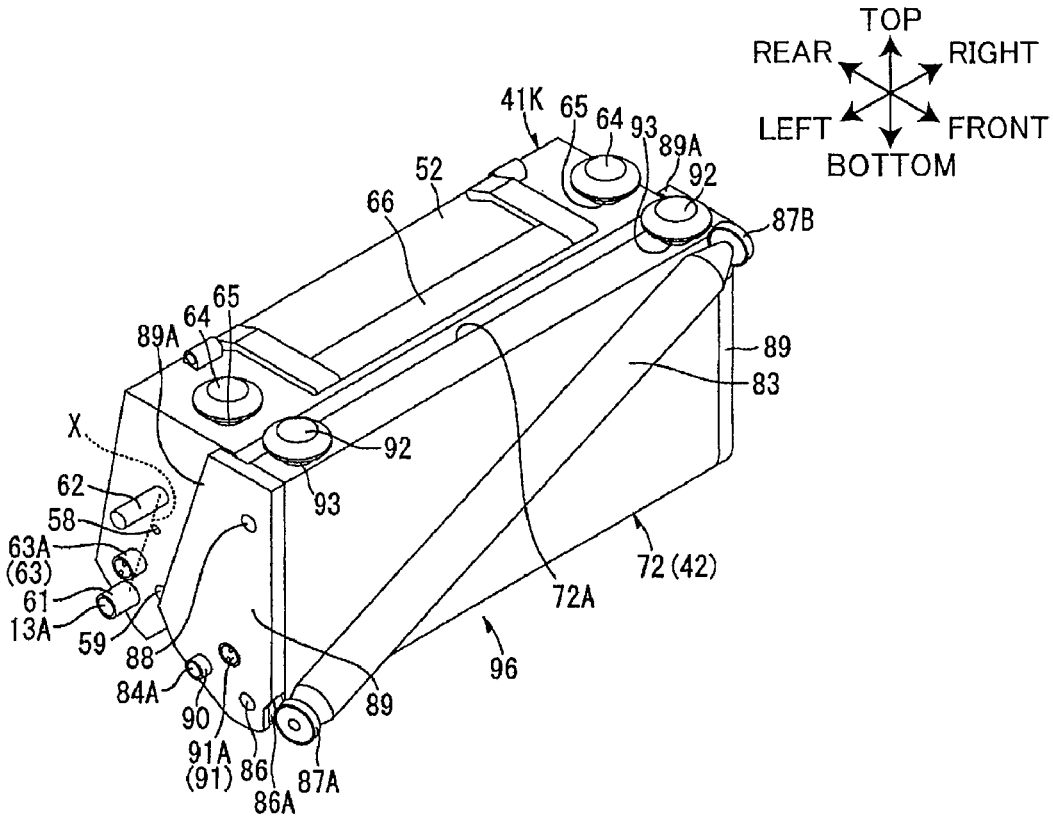
FIG. 4 is a left-front side perspective view of a developer cartridge and a waste toner box provided in a cleaning unit according to the embodiment.

Next, the developer cartridge 41 will be described in greater detail with reference to FIG. 4. In FIG. 4, the forwardmost black developer cartridge 41K (see FIG. 1) is shown integrally configured with a waste toner box 72 functioning as a receptacle in the cleaning unit 42 described later. The following description of the developer cartridge 41 will reference the black developer cartridge 41K in FIG. 4.

As shown in FIG. 4, left and right side surfaces of the developer casing 52 are flat and extend in a substantially vertical direction. The widthwise ends of rotational shafts for the agitator 58 and supply roller 59 are exposed in the left and right side surfaces of the developer casing 52. Widthwise ends 13A on a rotational shaft of the developing roller 13 protrude out of the left and right side surfaces of the developer casing 52 in the width direction. Cylindrical bosses 61 are integrally provided on the left and right side surfaces of the developer casing 52, protruding outward in the width direction for receiving the corresponding ends 13A of the rotational shaft. The bosses 61 cover all parts of the ends 13A except the widthwise endfaces thereof.

Columnar first protrusions 62 are integrally provided on the left and right side surfaces of the developer casing 52 above the center of the side surfaces and protrude outward in the width direction. In other words, the first protrusions 62 are provided on each developer cartridge 41 so as to protrude outward in the width direction. The first protrusions 62 protrude farther outward from the developer casing 52 than the corresponding ends 13A of the developing roller 13 and the bosses 61 (i.e., on the same side surfaces of the developer casing 52). The first protrusion 62 on each side surface is disposed above the corresponding end 13A of the developing roller 13 and boss 61 and is aligned with the end 13A of the developing roller 13 and the boss 61 along the extending direction of the first guide grooves 47 (see FIG. 3).

A coupling member 63 is provided on the left wall of the developer cartridge 41. The coupling member 63 integrally includes an output part (not shown), and an input part 63A. The output part is a gear that is engaged with gears (not shown) provided on each of the developing roller 13, supply roller 59, and agitator 58 (see FIG. 3) in the developer casing 52 to couple the developing roller 13, supply roller 59, and agitator 58 together.

The input part 63A is coupled with the output part and penetrates the left wall of the developer casing 52, protruding leftward from the left wall. The left end of the input part 63A does not protrude as far leftward as the left end of the boss 61 (i.e., is farther inward in the width direction). The input part 63A is positioned on the left surface of the developer casing 52 between the first protrusion 62 and the left end 13A of the developing roller 13 (boss 61) and falls on a straight line X connecting the first protrusion 62 to the end 13A in a left side view. The straight line X extends along the extending direction of the first guide grooves 47 (see FIG. 3).

With the input part 63A penetrating the left wall of the developer casing 52, the coupling member 63 is rotatably supported in the left wall of the developer casing 52. The rotational axis of the coupling member 63 extends in the width direction.

During an image-forming operation when the developer cartridge 41 is mounted in the main casing 2 (see FIG. 1), a motor (not shown) provided in the main casing 2 generates a drive force that is inputted into the input part 63A for rotating the coupling member 63. The developing roller 13, supply roller 59, and agitator 58 coupled to the output part of the coupling member 63 are also driven to rotate by the rotation of the coupling member 63.

As shown in FIG. 1, as the rotating agitator 58 agitates toner within the toner-accommodating chamber 54, a portion of the toner falls downward through the communication opening 56 and is supplied to the supply roller 59 in the developing chamber 55. The rotating supply roller 59 in turn supplies this toner to the developing roller 13. At this time, the toner is tribocharged between the supply roller 59 and the developing roller 13 to which a bias is applied. As the developing roller 13 rotates, the thickness-regulating blade 60 regulates the thickness of toner carried on the developing roller 13 to a uniform thin layer.

As shown in FIG. 4, a cap 64 shaped substantially like the frustum of a cone tapering toward the top is mounted on the top surface of the developer casing 52 near each widthwise end thereof (see FIG. 1). A spring 65 is interposed between each cap 64 and the top surface of the developer casing 52. The compressed spring 65 attempting to expand urges the cap 64 upward.

A handle 66 is mounted on the top surface of the developer casing 52 between the left and right caps 64. The handle 66 is capable of pivoting about the rear ends thereof between an orientation following the top surface of the developer casing 52 (see the developer cartridges 41C and 41M in FIG. 3) and an orientation erected upward from the top surface of the developer casing 52 (see the developer cartridges 41K and 41Y in FIG. 3).

(3) Cleaning Unit

The cleaning unit 42 shown in FIG. 3 functions to remove toner deposited on the conveying belt 18 (sometimes referred to as "waste toner"). The cleaning unit 42 includes a cleaning frame 70 serving as a supporting member, a cleaning roller 71 supported in the cleaning frame 70, and a waste toner box 72 detachably mounted on the cleaning frame 70.

(3-1) Cleaning Frame and Cleaning Roller

The cleaning frame 70 has a hollow box shape that is elongated in the width direction and open on the front, rear, top, and bottom sides. However, the width dimension of the cleaning frame 70 is smaller than the widthwise space formed between the left and right side plates 43 of the process frame 40. The cleaning frame 70 is tilted slightly forward from the vertical along the extending direction of the first guide grooves 47. The cleaning frame 70 has left and right side walls 73.

A second guide groove 74 is formed in each of the left and right side walls 73 of the cleaning frame 70. The second guide grooves 74 extend upward (specifically, upward along a slightly forward slope) in a straight line from a position substantially in the front-to-rear center in a region above the lower edge of the corresponding side walls 73 to the top edge of the side walls 73. Since the slightly forward sloping orientation is the extending direction of the first guide grooves 47 described above, the second guide groove 74 extends parallel to the first guide groove 47. The entire second guide groove 74 penetrates the corresponding side walls 73 in the width direction. The lower end of the second guide groove 74 is rounded substantially in a U-shape when viewed along the width direction.

A columnar second protrusion 69 is integrally provided on each of the left and right side walls 73, protruding outward in the width direction. Hence, the second protrusions 69 protrude outside the cleaning frame 70 in the width direction. The second protrusions 69 have a larger diameter than the first protrusions 62 on the developer cartridge 41 described above (see FIG. 4). The second protrusions 69 are provided in the upper rear portion of the corresponding side walls 73, rearward of the top end of the second guide grooves 74.

The cleaning roller 71 is elongated in the width direction and has a center shaft 71A extending in the width direction. The cleaning roller 71 is longer in the width direction than any of the conveying belt 18, photosensitive drum 11, and developing roller 13. The cleaning roller 71 is rotatably supported in the lower rear portions of the left and right side walls 73. More specifically, the left end of the center shaft 71A in the cleaning roller 71 is rotatably supported in the lower rear portion of the left side walls 73, while the right end of the center shaft 71A is rotatably supported in the lower rear portion of the right side walls 73. When viewed along the width direction, the lower end of the second guide groove 74 is positioned diagonally in front of and above the cleaning roller 71. The lower peripheral surface of the cleaning roller 71 is exposed through the opening formed in the bottom surface of the cleaning frame 70. Both widthwise ends of the center shaft 71A protrude out of the corresponding side walls 73 constituting the cleaning frame 70 in the width direction.

The cleaning roller 71 is positioned lower than the second protrusions 69, and the center shaft 71A of the cleaning roller 71 is aligned with the second protrusions 69 in the extending direction of the second guide groove 74 (first guide grooves 47). As described above, since the second protrusions 69 are provided on the cleaning frame 70, which supports the cleaning roller 71, the positions of the second protrusions 69 are fixed relative to the cleaning roller 71.

Further, the cleaning frame 70 is slidably supported on the process frame 40 while itself rotatably supporting the cleaning roller 71. Specifically, the cleaning frame 70 is accommodated inside the process frame 40. In this state, the left second protrusion 69 on the cleaning frame 70 fits loosely into the upper guide hole 49A formed in the left side plate 43 of the process frame 40 from the right, and the right second protrusion 69 fits loosely into the upper guide hole 49A formed in the right side plate 43 from the left. In addition, the left end of the center shaft 71A in the cleaning roller 71 fits loosely into the lower guide hole 49B formed in the left side plate 43 from the right, and the right end of the center shaft 71A fits loosely into the lower guide hole 49B formed in the right side plate 43 from the left. As described above, each of the guide holes 49 (the upper guide hole 49A and lower guide hole 49B) is elongated in the extending direction of the first guide grooves 47 (second guide grooves 74). Accordingly, the second protrusions 69 and the center shaft 71A of the cleaning roller 71 fitted with play in the corresponding guide holes 49 can freely slide along the elongated direction of the guide holes 49.

Therefore, the cleaning frame 70 is supported in the process frame 40 via the cleaning roller 71 and second protrusions 69 so as to be capable of sliding along the elongated direction of the guide holes 49 (i.e., the extending direction of the first guide grooves 47 and second guide grooves 74, which is the direction in which the cleaning roller 71 moves with the center shaft 71A fitted into the guide holes 49 with play).

The second protrusions 69 protrude outwardly from the corresponding side plates 43 formed in the process frame 40 in the width direction and are fitted loosely into the corresponding upper guide holes 49A (see FIGS. 8 through 10 described later).

(3-2) Waste Toner Box

As shown in FIG. 4, the waste toner box 72 has a hollow box shape with an opening in the bottom side and is slightly wider than the developer casing 52 of the developer cartridge 41. However, the width dimension of the waste toner box 72 is smaller than the widthwise space formed between the left and right side walls 73 of the cleaning frame 70 (see FIG. 3).

The top surface of the waste toner box 72 is flat and substantially horizontal, while the left and right side surfaces and the front surface are flat and substantially vertical. However, a rear surface 72A of the waste toner box 72 slopes upward and slightly forward, substantially following the extending direction of the first guide grooves 47, as shown in FIG. 3, so as to be substantially parallel to the front surface of the developer casing 52 on the black developer cartridge 41K. Hence, the outline and interior space of the waste toner box 72 viewed along the width direction grow narrower toward the top.

Figure 5:
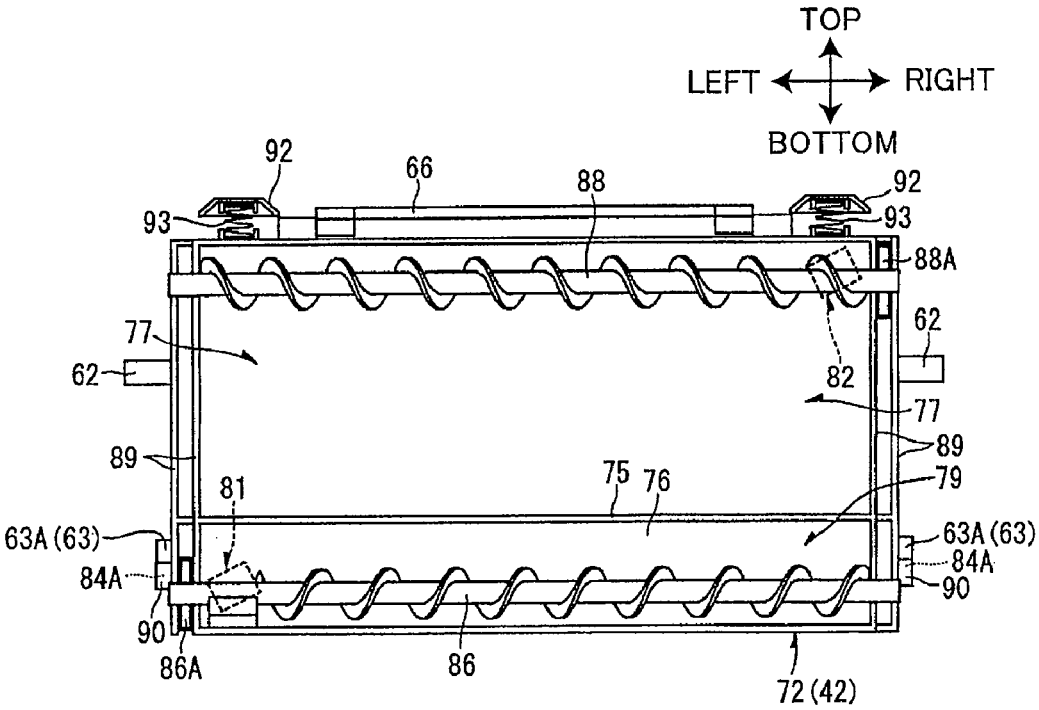
FIG. 5 is a cross-sectional view of the cleaning unit along a plane indicated by arrows V-V in FIG. 3.

Left and right side walls 89 define the interior space of the waste toner box 72 in the width direction. The side walls 89 are both hollow, as illustrated in FIG. 5.

A first partitioning plate 75 extending substantially along the horizontal is provided inside the waste toner box 72 at a position lower than the vertical center of the waste toner box 72. A second partitioning plate 76 is integrally provided on the first partitioning plate 75, extending downward from substantially the front-to-rear center thereof. The first partitioning plate 75 partitions the interior of the waste toner box 72 into a waste-toner-accommodating chamber 77 occupying the upper section, and a lower space, while the second partitioning plate 76 partitions the lower space into a first recovery chamber 78 occupying the rear section, and a second recovery chamber 79 occupying the front section (see FIG. 3). The open portion in the bottom surface of the waste toner box 72 described above communicates only with the first recovery chamber 78. A communicating hole 80 is formed in the second partitioning plate 76 so as to penetrate the second partitioning plate 76 in the front-to-rear direction, allowing communication between the first recovery chamber 78 and the second recovery chamber 79.

Figure 6:
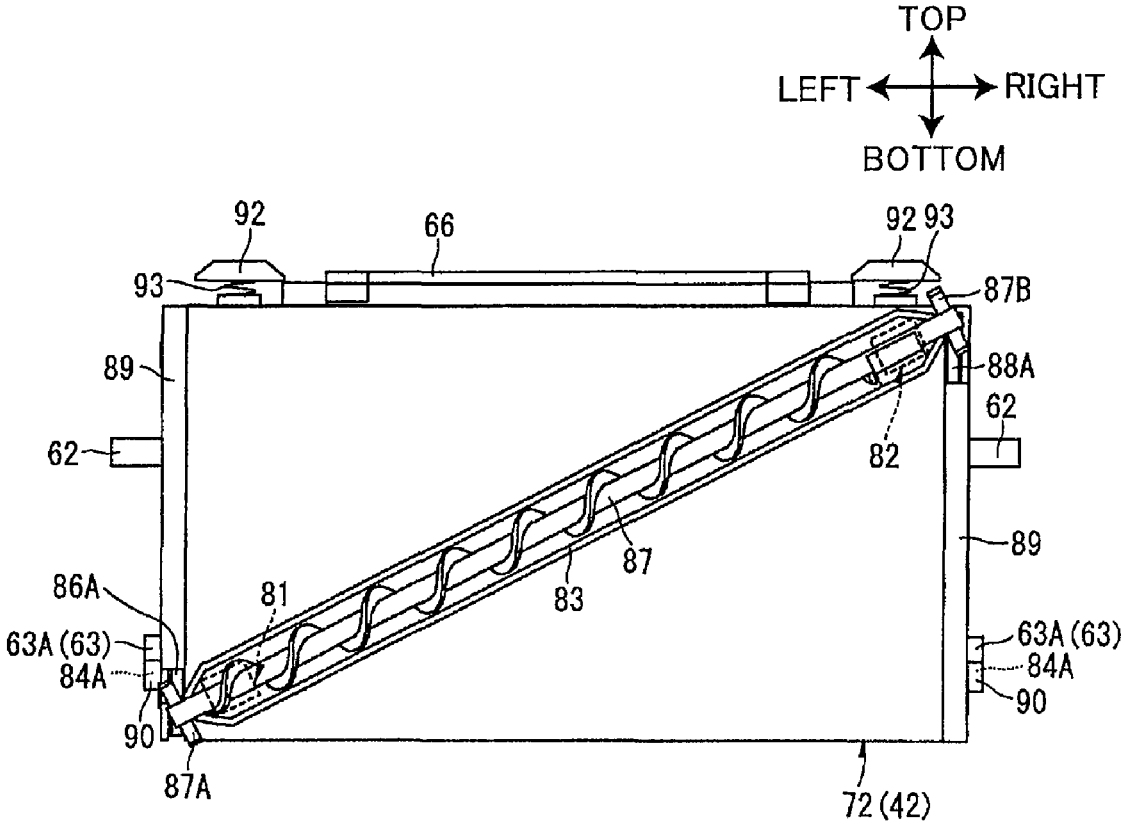
FIG. 6 is a cross-sectional view of the cleaning unit along the plane indicated by arrows VI-VI in FIG. 3.

An outlet 81 is formed in the waste toner box 72 in the lower left region thereof, and an inlet 82 is formed in the front surface in the upper right region thereof. The outlet 81 is in communication only with the second recovery chamber 79, and the inlet 82 is in communication only with the waste-toner-accommodating chamber 77 (see FIGS. 5 and 6). As shown in FIG. 6, both the outlet 81 and inlet 82 are substantially rectangular in shape and elongated along a straight line connecting the two. A connecting pipe 83 linking the outlet 81 and inlet 82 is integrally provided on the front surface of the waste toner box 72 (see also FIG. 4).

The connecting pipe 83 extends linearly in a rightward direction sloping upward relative to the horizontal plane. The left end (lower end) of the connecting pipe 83 is connected to the outlet 81 on the front surface of the waste toner box 72, with no gaps in the peripheral part of the outlet 81. The right end (upper end) of the connecting pipe 83 is connected to the inlet 82 on the front surface of the waste toner box 72, with no gaps in the peripheral part of the inlet 82. Hence, the outlet 81 and inlet 82 are in communication with the interior of the connecting pipe 83 and not in communication with the exterior of the waste toner box 72. Both ends of the connecting pipe 83 in the width direction grow narrower toward the outer ends.

As shown in FIG. 3, the waste toner box 72 is provided with a recovery roller 84, a scraping blade 85, a primary auger 86, a secondary auger 87, and a tertiary auger 88.

The recovery roller 84 is disposed in the first recovery chamber 78. The recovery roller 84 is elongated in the width direction and has a center shaft 84A extending in the width direction.

The width dimensions of the recovery roller 84 and the cleaning roller 71 are substantially identical, but the cleaning roller 71 is longer than the developing roller 13 in the width direction, as described above. Accordingly, the waste toner box 72 provided with the recovery roller 84 having substantially the same width dimension of the cleaning roller 71 is wider than the developer cartridge 41 provided with the developing roller 13 (see FIG. 4).

The recovery roller 84 is rotatably supported in the first recovery chamber 78 by the left and right side walls 89 of the waste toner box 72. More specifically, the left end of the center shaft 84A provided in the recovery roller 84 is rotatably supported in the left side wall 89, and the right end of the center shaft 84A is rotatably supported in the right side wall 89. In this state, the bottom peripheral surface of the recovery roller 84 is exposed through the opening formed in the bottom surface of the waste toner box 72, while the front peripheral surface of the recovery roller 84 faces the communicating hole 80 formed in the second partitioning plate 76 from the rear side thereof. Both widthwise ends of the center shaft 84A protrude out of the corresponding side walls 89 in the width direction (see also FIGS. 4 through 6).

The scraping blade 85 is formed in a plate shape extending along the width direction. A base edge (top edge) of the scraping blade 85 is fixed to the second partitioning plate 76 at the upper peripheral edge of the communicating hole 80, while the distal end (bottom edge) contacts the peripheral surface of the recovery roller 84 with pressure.

The primary auger 86 is disposed in the second recovery chamber 79 and faces the communicating hole 80 in the second partitioning plate 76 from the front side. As shown in FIG. 5, the primary auger 86 includes a shaft extending in the width direction and rotatably supported in the side walls 89 of the waste toner box 72, and a spiral blade formed on the surface of the shaft. The overall structure of the primary auger 86 extends substantially along the horizontal.

The left end of the spiral blade in the primary auger 86 faces the rear side of the outlet 81 (see FIG. 3). A gear 86A is fixed to the left end of the shaft of the primary auger 86. The gear 86A is disposed in the lower front corner of a hollow region formed in the left side wall 89 in the waste toner box 72. The front portion of the gear 86A is exposed outside (and more specifically on the front side) of the left side wall 89 (see FIGS. 4 and 6) through an opening of the hollow region.

As shown in FIG. 6, the secondary auger 87 is disposed inside the connecting pipe 83. The secondary auger 87 includes a shaft extending diagonally upward to the right along the sloped direction of the connecting pipe 83 so as to be parallel to the connecting pipe 83, the shaft being rotatably supported in both widthwise ends of the connecting pipe 83; and a spiral blade formed on the surface of the shaft. The left end (lower end) of the spiral blade formed in the secondary auger 87 faces the outlet 81 formed on the front surface of the waste toner box 72, and the right end (upper end) faces the inlet 82 (see FIGS. 3 and 6). In this state, the left end of the shaft in the secondary auger 87 is projected from the left end of the connecting pipe 83 to the left side thereof. A gear 87A is fixed to the left end of the shaft. Further, the right end of the shaft in the secondary auger 87 is projected from the right end of the connecting pipe 83 to the right side thereof. A gear 87B is fixed to the right end of the shaft.

As shown in FIG. 5, the tertiary auger 88 is disposed in the upper region of the waste-toner-accommodating chamber 77, which is the upper portion of the waste toner box 72 (see FIG. 3). The tertiary auger 88 includes a shaft extending in the width direction that is rotatably supported in the side walls 89 of the waste toner box 72, and a spiral blade formed on the surface of the shaft. The overall tertiary auger 88 extends substantially in a horizontal direction. The right end of the blade in the tertiary auger 88 faces the rear side of the inlet 82 (see FIG. 3). A gear 88A is fixed to the right end of the shaft. The gear 88A is disposed in the upper rear corner of a hollow portion formed in the right side wall 89 constituting the waste toner box 72. The front portion of the gear 88A is exposed outside (specifically, on the front side) of the right side wall 89 (see FIG. 6) through an opening of the hollow region.

As shown in FIG. 6, the gear 86A of the primary auger 86 is engaged with the gear 87A of the secondary auger 87, and the gear 87B of the secondary auger 87 is engaged with the gear 88A of the tertiary auger 88. Therefore, when the primary auger 86 (see FIG. 5) rotates in a prescribed direction, the secondary auger 87 receives a drive force by the gear 87A from the gear 86A of the primary auger 86 and rotates in the direction opposite the rotational direction of the primary auger 86. When the secondary auger 87 rotates, the tertiary auger 88 (see FIG. 5) receives a drive force by the gear 88A from the gear 87B of the secondary auger 87 and rotates in the direction opposite the rotational direction of the secondary auger 87 (in other words, the same rotational direction as the primary auger 86).

When the primary auger 86, secondary auger 87, and tertiary auger 88 rotate in this way, the blade of the primary auger 86 appears to move leftward while rotating, the blade of the secondary auger 87 appears to move diagonally upward to the right while rotating, and the blade of the tertiary auger 88 appears to move leftward while rotating (see FIG. 5).

As shown in FIG. 4, the widthwise endfaces of the shafts in the primary auger 86 and tertiary auger 88 are exposed in the left and right side surfaces (side walls 89) of the waste toner box 72. Further, as described above, the widthwise ends of the center shaft 84A in the recovery roller 84 protrude outward in the width direction from the corresponding side walls 89 of the waste toner box 72 (see FIGS. 5 and 6).

A cylindrical boss 90 is integrally provided near the lower end of both left and right side surfaces on the waste toner box 72 at positions corresponding to the widthwise ends of the center shaft 84A in the recovery roller 84 and protrudes outward in the width direction. The widthwise ends of the center shaft 84A are disposed in the corresponding bosses 90 so that the bosses 90 cover all but the widthwise endfaces on the ends of the center shaft 84A.

As shown in FIG. 4, a coupling member 91 is provided in the waste toner box 72. The coupling member 91 integrally includes an output part (not shown), and an input part 91A.

The output part is a gear and is engaged with a gear (not shown) provided on the left end of the recovery roller 84 (see FIG. 3) and the gear 86A of the primary auger 86 (see FIG. 5) in the hollow portion of the left side wall 89 on the waste toner box 72 (see FIG. 5). Consequently, the coupling member 91 is coupled to each of the recovery roller 84 and the primary auger 86 (see FIG. 3) at this output part.

The input part 91A is coupled with the output part (not shown) and penetrates the left side wall 89. In this state, the left endface of the input part 91A is exposed in the left surface of the waste toner box 72. By penetrating the left side wall 89 with the input part 91A, the coupling member 91 is rotatably supported in the left side wall 89. The rotational axis of the coupling member 91 extends in the width direction.

To clean the conveying belt 18 in the printer 1 shown in FIG. 1 (hereinafter referred to as "belt cleaning"), a motor (not shown) provided in the main casing 2 (see FIG. 1) generates a drive force that is inputted into the input part 91A for rotating the coupling member 91. The rotation of the coupling member 91 rotates the recovery roller 84 and primary auger 86 coupled with the coupling member 91.

Caps 92 having the same shape as the caps 64 of the developer cartridge 41 described above are mounted on the top surface of the waste toner box 72 near both widthwise ends thereof. More specifically, a spring 93 is interposed between each cap 92 and the top surface of the waste toner box 72 (see FIG. 3). The compressed springs 93 attempting to expand urge the caps 92 upward.

The rear edge of each left and right side wall 89 on the waste toner box 72 forms a protruding part 89A that protrudes farther rearward than the rear surface 72A of the waste toner box 72. Accordingly, the left and right protruding parts 89A and the rear surface 72A of the waste toner box 72 are substantially U-shaped with an opening on the rear side in a plan view. The gap between the left and right protruding parts 89A is greater than the gap between the left and right side surfaces of the developer casing 52 constituting the developer cartridge 41.

Figure 7A:
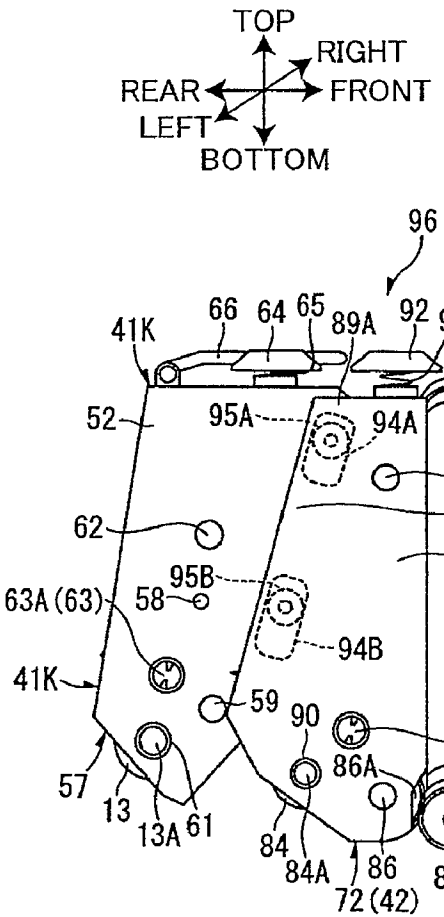
FIGS. 7A-7C show left side views of the developer cartridge and the waste toner box supported on the black developer cartridge according to the embodiment.

As shown in FIG. 7A, two guide recesses 94 (94A and 94B) aligned vertically are formed in the inner surface of each protruding part 89A so as to be recessed outwardly in the width direction. In other words, a pair of guide recesses 94 (94A and 94B) separated in the width direction is formed in both the upper portion and the lower portion of the waste toner box 72.

The two guide recesses 94A and 94B formed in each protruding part 89A are aligned in the extending direction of the first guide grooves 47 and the second guide grooves 74 (see FIG. 3). Each of the guide recesses 94A and 94B is elongated in the same direction. The upper guide recess 94 formed in each protruding part 89A will be referred to as an upper guide recess 94A, and the lower guide recess 94 will be referred to as a lower guide recess 94B.

Unlike the other developer cartridges 41, the forwardmost black developer cartridge 41K has two guide protrusions 95 (95A and 95B) aligned vertically and protruding outwardly in the width direction integrally formed on each left and right side surfaces of the developer casing 52 near the front edge thereof. In other words, there are a pair of guide protrusions 95 (95A and 95B) whose ends protrude outwardly in the width direction disposed in both the upper portion and the lower portion of the developer casing 52 for the black developer cartridge 41K. The guide protrusions 95A and 95B are rollers that are rotatably supported in the developer casing 52.

In each of the left and right side surfaces of the developer casing 52, the two guide protrusions 95A and 95B are aligned in the extending direction of the first guide grooves 47 and second guide grooves 74 (see FIG. 3). The upper guide protrusion 95 will be referred to as an upper guide protrusion 95A, and the lower guide protrusion 95 will be referred to as a lower guide protrusion 95B.

The waste toner box 72 is disposed so as to confront the developer casing 52 of the black developer cartridge 41K from the front side and is slidably supported on the developer casing 52. That is, the waste toner box 72 and black developer cartridge 41K can be considered as a unit in which the two components can move relative to each other, or, from another perspective, the waste toner box 72 can be considered part of the black developer cartridge 41K.

Specifically, the upper guide protrusion 95A on the left side of the black developer cartridge 41K is fitted loosely into the upper guide recess 94A formed in the left protruding part 89A from the right, and the upper guide protrusion 95A on the right side (not shown) is fitted loosely into the upper guide recess 94A formed in the right protruding part 89A (not shown) from the left. Further, the lower guide protrusion 95B provided on the left side of the black developer cartridge 41K is fitted loosely into the lower guide recess 94B formed in the left protruding part 89A from the right, and the lower guide protrusion 95B on the right side (not shown) is fitted loosely into the lower guide recess 94B formed in the right protruding part 89A from the left.

As described above, each of the upper guide recesses 94A and lower guide recess 94B is elongated in the extending direction of the first guide grooves 47 and second guide grooves 74. Accordingly, each guide protrusion 95A and 95B loosely fitted into the corresponding guide recess 94A and 94B is capable of sliding along the elongated direction of the guide recess 94A and 94B (along the extending direction of the first guide grooves 47 and second guide grooves 74). In this way, the black developer cartridge 41K having the guide protrusions 95A and 95B and the waste toner box 72 in which the guide recesses 94A and 94B are formed can be formed as a unit while being capable of moving relative to each other in the elongated direction of the guide recesses 94A and 94B.

In this state, the front edge of the black developer cartridge 41K is sandwiched between the protruding parts 89A of the waste toner box 72 on the outer widthwise sides thereof (see FIG. 4). In this state, the waste toner box 72 is slidably supported in the guide recesses 94A and 94B of the black developer cartridge 41K along the longitudinal direction of the guide recesses 94A and 94B (extending direction of the first guide grooves 47 and second guide grooves 74). Hence, the guide recesses 94A and 94B can be said to have a longitudinal dimension that follows the moving direction of the waste toner box 72. Further, if the waste toner box 72 is considered part of the black developer cartridge 41K, as described above, the developing roller 13 of the black developer cartridge 41K and the recovery roller 84 of the waste toner box 72 can be said to be both disposed on one end (bottom end) of the black developer cartridge 41K in the sliding direction of the developer casing 52 and waste toner box 72 (the extending direction or the longitudinal direction of the guide recesses 94A and 94B; see FIG. 1).

In FIG. 7A, the waste toner box 72 is in a lowermost position relative to the black developer cartridge 41K, with the guide protrusions 95A and 95B in the top ends of the guide recesses 94A and 94B. At this time, the top surface of the waste toner box 72 is positioned lower than the top surfaces of the developer casing 52.

Figure 7B:
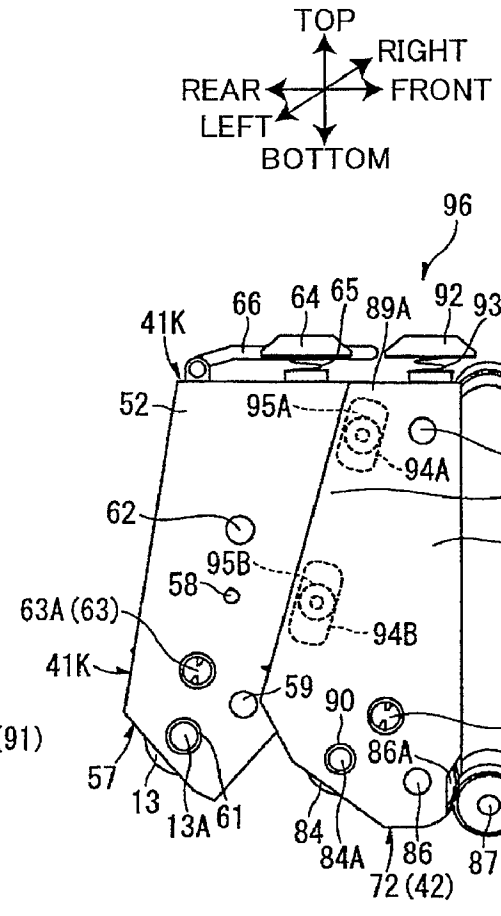

In FIG. 7B, the waste toner box 72 has been raised relative to the black developer cartridge 41K to an intermediate position in which the guide protrusions 95A and 95B are positioned substantially in the vertical centers of the guide recesses 94A and 94B. At this time, the top surface of the waste toner box 72 is substantially flush with the top surface of the developer casing 52.

Figure 7C:
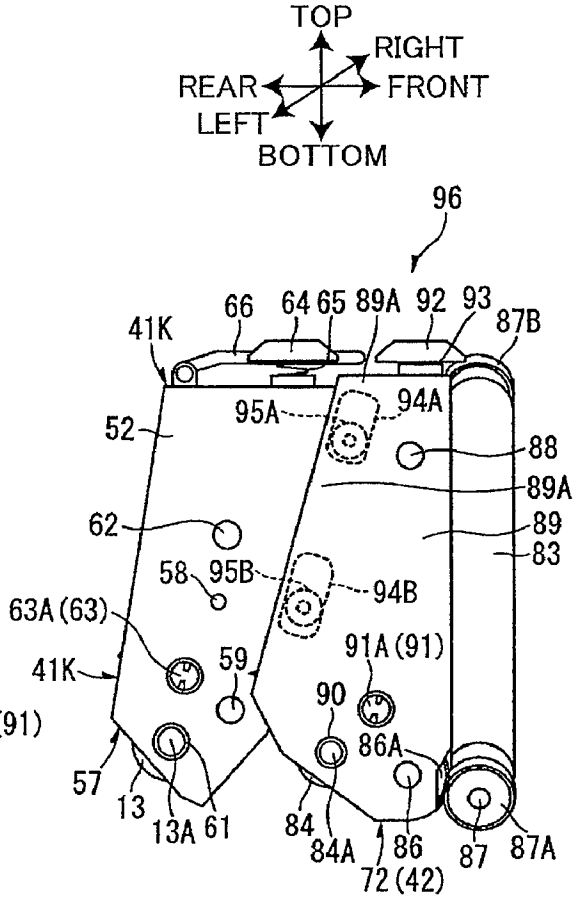

In FIG. 7C, the waste toner box 72 has been further raised relative to the black developer cartridge 41K to an uppermost position in which the guide protrusions 95A and 95B are in the bottom ends of the guide recesses 94A and 94B. At this time, the top surface of the waste toner box 72 is positioned higher than the top surface of the developer casing 52.

When the black developer cartridge 41K and the waste toner box 72 are configured as a unit in this way, the left cap 64 on the black developer cartridge 41K and the left cap 92 on the waste toner box 72 are in the same widthwise position, and the right cap 64 on the black developer cartridge 41K and the right cap 92 on the waste toner box 72 are in the same widthwise position, as illustrated in FIG. 4.

As shown in FIG. 3, the waste toner box 72 is detachably mounted in the cleaning frame 70 when configured as a unit with the black developer cartridge 41K. In other words, the waste toner box 72 is detachably mounted in the process frame 40, which supports the cleaning frame 70. Operations for mounting the waste toner box 72 in and removing the waste toner box 72 from the process frame 40 (cleaning frame 70) are described below.

(4) Mounting and Removal of the Developer Cartridge and Waste Toner Box Relative to the Process Frame Next, operations for mounting the developer cartridge 41 and waste toner box 72 in and removing the developer cartridge 41 and waste toner box 72 from the process frame 40 will be described.

First, mounting a single developer cartridge 41 in or removing a single developer cartridge 41 from the process frame 40 will be described with reference to the yellow developer cartridge 41Y in FIG. 3. At this time, the process frame 40 (process unit 31) is pulled out from the front side of the main casing 2. When mounting the developer cartridge 41 in the process frame 40, the operator grips the erect handle 66 on the developer cartridge 41 and positions the developer cartridge 41 over the process frame 40 while the process frame 40 remains pulled out from the main casing 2 and in a substantially horizontal orientation.

The operator moves the developer cartridge 41 in the front-to-rear direction near the corresponding photosensitive drum 11 (the yellow photosensitive drum 11Y in the case of the yellow developer cartridge 41Y) and subsequently inserts the developer cartridge 41 into the process frame 40 through the open top surface thereof. At this time, the left and right ends 13A (see FIG. 4) on the rotational shaft of the developing roller 13, which are covered by the bosses 61, are received in the corresponding first guide grooves 47.

When the operator continues to insert the developer cartridge 41 into the process frame 40, the left and right ends 13A of the developing roller 13 are guided along the corresponding first guide grooves 47 so that the developer cartridge 41 moves at a slightly downward and rearward slope along the extended direction of the first guide grooves 47.

As the developer cartridge 41 is further inserted, first the input part 63A of the coupling member 63 and then the outer widthwise ends of the first protrusions 62 (see FIG. 4) are received in and guided by the corresponding first guide grooves 47. At this time, the outer widthwise ends of the first protrusions 62 protrude further outward in the width direction than the process frame 40 through the cutout parts 48 of the first guide grooves 47 penetrating the side plates 43 in the width direction (see FIGS. 8 through 10 described later).

When the operator continues to insert the developer cartridge 41, the left and right ends 13A of the developing roller 13 arrive at the bottom ends of the corresponding first guide grooves 47. At the same time, the outer widthwise ends of the first protrusions 62 arrive at the bottom ends of the corresponding cutout parts 48 while still protruding farther outward than the process frame 40 (see also FIG. 8). The bottom peripheral surface of the developing roller 13 exposed in the opening 57 formed in the bottom of the developer casing 52 contacts the peripheral surface of the corresponding photosensitive drum 11 from a position slightly above and forward thereof (see the developer cartridges 41C and 41M in FIG. 3).

This completes the operation of mounting a single developer cartridge 41 with respect to the process frame 40. As described above, the outer widthwise ends of the first protrusions 62 provided on the developer cartridge 41 are positioned in the bottom ends of the corresponding cutout parts 48 (part of the first guide grooves 47; see FIG. 8). Accordingly, the first protrusions 62 are received in the corresponding first guide grooves 47 when the developer cartridge 41 is mounted in the process frame 40.

To remove a single developer cartridge 41 from the process frame 40 from this state, the operator grips the handle 66 on the developer cartridge 41 and pulls the developer cartridge 41 upward. At this time, the outer widthwise ends of the first protrusions 62, the input part 63A of the coupling member 63, and the ends 13A of the developing roller 13 are guided upward along the corresponding first guide grooves 47. Consequently, the developer cartridge 41 moves upward along a slightly forward slope, i.e., along the extending direction of the first guide grooves 47.

Removal of the developer cartridge 41 from the process frame 40 is complete when the first protrusions 62, the input part 63A of the coupling member 63, and the ends 13A of the developing roller 13 are extracted from the corresponding first guide grooves 47.

Next, a description will given for mounting and removing the black developer cartridge 41K and waste toner box 72 as a unit relative to the process frame 40. Here, a developing unit 96 will refer to the integrated black developer cartridge 41K and waste toner box 72.

As when mounting the developer cartridge 41 in the process frame 40, the developing unit 96 is similarly mounted by lifting up and gripping the handle 66 on the black developer cartridge 41K. Next, with the process frame 40 pulled out of the main casing 2, the operator moves the developing unit 96 above the process frame 40.

The operator adjusts the front-to-rear position of the developing unit 96 to approach the corresponding black photosensitive drum 11K and inserts the developing unit 96 into the process frame 40 through the opening in the top side thereof.

At this time, the ends 13A on the rotational shaft of the developing roller 13 that are covered by the bosses 61 (see FIG. 4) are received in the corresponding first guide grooves 47. Further, the waste toner box 72 in the developing unit 96 is inserted into the cleaning frame 70 through the top thereof, while the widthwise ends of the center shaft 84A in the recovery roller 84 that are covered by the bosses 90 (see FIG. 4) are received in the corresponding second guide grooves 74 of the cleaning frame 70.

When the operator continues to insert the developing unit 96, the ends 13A of the developing roller 13 are guided along the corresponding first guide grooves 47 so that the developer cartridge 41 moves downward at a slight rearward slope along the extending direction of the first guide grooves 47. Further, the widthwise ends of the center shaft 84A in the recovery roller 84 are guided along the second guide grooves 74 so that the waste toner box 72 moves downward at a slight rearward slope along the extending direction of the second guide grooves 74. Since the first guide grooves 47 and second guide grooves 74 extend parallel to each other, the entire developing unit 96 moves downward at a slight rearward slope along the extending direction of the first guide grooves 47 and second guide grooves 74.

As the developing unit 96 is inserted further, first the input part 63A of the coupling member 63 and then the widthwise ends of the first protrusions 62 are received in and guided by the corresponding first guide grooves 47. At this time, the widthwise ends of the first protrusions 62 protrude farther outward in the width direction than the process frame 40 through the cutout parts 48 (see FIGS. 8 through 10 described later). In addition, the widthwise ends of the center shaft 84A in the recovery roller 84 continue to be guided along the corresponding second guide grooves 74.

As the operator continues to insert the developing unit 96, the ends 13A of the developing roller 13 arrive at the bottom ends of the corresponding first guide grooves 47. At the same time, the widthwise ends of the first protrusions 62 arrive at the bottom ends of the corresponding cutout parts 48 while still protruding farther outward than the process frame 40 (see also FIG. 8). Further, the bottom peripheral surface of the developing roller 13 exposed through the opening 57 contacts the peripheral surface of the corresponding black photosensitive drum 11K from a position diagonally above and forward thereof (see FIG. 2).

Similarly, the widthwise ends of the center shaft 84A in the recovery roller 84 arrive at the bottom ends of the corresponding second guide grooves 74 (not shown). Further, the bottom peripheral surface of the recovery roller 84 exposed through the opening in the bottom surface of the waste toner box 72 contacts the peripheral surface of the cleaning roller 71 supported in the cleaning frame 70 at a position above and slightly forward thereof (see FIG. 2).

This completes the operation of mounting the developing unit 96 (the integrated black developer cartridge 41K and waste toner box 72) into the process frame 40, as shown in FIG. 2. Hence, the waste toner box 72 is mounted in the cleaning frame 70 by mounting the developing unit 96 in the process frame 40. The waste toner box 72 mounted in the cleaning frame 70 is also accommodated in the cleaning frame 70. As described above, the outer widthwise ends of the first protrusions 62 provided on the black developer cartridge 41K are positioned in the bottom ends of the corresponding cutout parts 48 (a portion of the first guide grooves 47 shown in FIG. 3) at this time. Therefore, the first protrusions 62 on the black developer cartridge 41K remain in the corresponding first guide grooves 47 while the developing unit 96 is in a mounted state in the process frame 40.

When removing the developing unit 96 from the process frame 40 from this state, the operator grips the handle 66 of the black developer cartridge 41K and lifts the developing unit 96 upward, as illustrated in FIG. 3. At this time, the outer widthwise ends of the first protrusions 62 provided on the black developer cartridge 41K, the input part 63A of the coupling member 63, and the ends 13A of the developing roller 13 are guided upward in the corresponding first guide grooves 47 so that the black developer cartridge 41K moves upward along a slightly forward slope, i.e., along the extending direction of the first guide grooves 47. In addition, the widthwise ends of the center shaft 84A provided in the recovery roller 84 are guided along the corresponding second guide grooves 74 formed in the cleaning frame 70 so that the waste toner box 72 moves upward along a slightly forward slope, i.e., along the extending direction of the second guide grooves 74. Hence, the entire developing unit 96 moves upward along a slightly forward slope, i.e., along the extending direction of the first guide grooves 47 and second guide grooves 74.

Removal of the developing unit 96 from the process frame 40 is complete after the first protrusions 62, the input part 63A of the coupling member 63, and the ends 13A of the developing roller 13 are extracted from the corresponding first guide grooves 47 and the widthwise ends of the center shaft 84A in the recovery roller 84 are extracted from the corresponding second guide grooves 74. By removing the developing unit 96 from the process frame 40, the waste toner box 72 is also removed from the cleaning frame 70.

When all four developer cartridges 41 and the waste toner box 72 (developing unit 96) are mounted in the process frame 40 according to the operations described above, the assembly of the process unit 31 is complete.

(5) Mounting and Removal of the Process Unit Relative to the Main Casing

Next, operations for mounting the process unit 31 in the main casing 2 and removing the process unit 31 from the main casing 2 will be described.

When mounting the process unit 31 in the main casing 2, the operator first rotates the cover 99 down toward the front to expose the mounting opening 98 in the front side. Next, the operator grips the handle 50 on the front side and positions the process unit 31 in front of the mounting opening 98. Here, it will be assumed that the process unit 31 shown in FIG. 3 has been completely assembled, i.e., that all developer cartridges 41 and the waste toner box 72 have been mounted in the process frame 40.

At this time, the left restraining rail 100 is aligned in the width direction with the left cap 64 provided on each developer cartridge 41 of the process unit 31 and the left cap 92 provided on the waste toner box 72, while the right restraining rail 100 is aligned in the width direction with the right cap 64 on each developer cartridge 41 of the process unit 31 and the right cap 92 provided on the waste toner box 72. Further, the tops of the caps 64 and 92 are positioned higher than the bottom edges of the corresponding restraining rails 100 (see the developer cartridges 41C and 41M and caps 64 in FIG. 3).

Next, the operator inserts the process unit 31 into the accommodating space 97 formed in the main casing 2 through the mounting opening 98. When the process unit 31 is inserted into the accommodating space 97, the process unit 31 advances rearward in a substantially horizontal direction guided by guide rails (not shown) provided in the accommodating space 97 while remaining above and separated from the conveying belt 18.

If the handle 66 is still erect on a developer cartridge 41 when the process unit 31 is inserted into the main casing 2 (see the yellow developer cartridge 41Y in FIG. 3), the handle 66 contacts the peripheral edge of the front wall 3 above the mounting opening 98 when passing through the mounting opening 98 and rotates forward to a horizontal orientation. Accordingly, the handles 66 on all developer cartridges 41 are ultimately oriented to follow the top surfaces of the developer casings 52 (see the developer cartridges 41C and 41M in FIG. 3).

As the operator continuously inserts the process unit 31, the caps 64 on each developer cartridge 41 in order beginning from the rearmost developer cartridge 41 come into contact with the front of the corresponding restraining rails 100 and move along the bottoms of the restraining rails 100. Consequently, each cap 64 is pushed downward by the corresponding restraining rail 100. Since the caps 64 are shaped substantially like the frustum of a cone tapering toward the top, as described earlier, the caps 64 have a sloped side surface. When the caps 64 contact the bottom edge of the corresponding restraining rails 100, the sloped side surfaces are substantially parallel to the portion of the restraining rails 100 near the mounting opening 98 sloping upward and forward, allowing the caps 64 to move smoothly to the bottoms of the restraining rail 100 without catching on the same.

As the process unit 31 continues to be inserted until nearly accommodated in the accommodating space 97, as shown in FIG. 2, the caps 92 on the waste toner box 72 contact the fronts of the corresponding restraining rails 100 and move along the bottoms of the same. Thus, each of the caps 92 is pushed downward by the corresponding restraining rails 100. Since the caps 92 have the same shape as the caps 64 on the developer cartridges 41, the caps 92 also move smoothly to the bottoms of the restraining rails 100 without catching on the same.

At this time, the caps 64 on all developer cartridges 41 and the caps 92 on the waste toner box 72 are pushed downward by the corresponding restraining rails 100. Accordingly, the springs 65 are compressed between the downwardly pressed caps 64 and the top surfaces of the developer casings 52. The force with which the springs 65 exert to expand is applied downward onto the developer casings 52, thereby urging the developer casings 52 downward. The springs 93 on the waste toner box 72 are also compressed between the downwardly pressed caps 92 and the top surface of the waste toner box 72. The force with which the springs 93 exert to expand is applied downward onto the waste toner box 72, thereby urging the waste toner box 72 downward.

While not completely accommodated in the accommodating space 97, the process unit 31 still does not contact the conveying belt 18 but remains a distance thereabove. Once inserted to the point that the process unit 31 is completely accommodated in the accommodating space 97, the process unit 31 leaves the guide rails (not shown) in the accommodating space 97 and drops slightly, as illustrated in FIG. 1. The mounting of the process unit 31 in the main casing 2 is complete when the operator subsequently rotates the cover 99 upward to cover the mounting opening 98.

When the operator rotates the cover 99 upward to its closed position, the cover 99 contacts and applies pressure to the front end of the handle 50 rotated downward from the front plate 44 of the process frame 40, as shown in FIG. 2. Consequently, the handle 50 pivots upward until orientated along the front surface of the front plate 44, as shown in FIG. 1, at which time the handle 50 is accommodated in the accommodating space 97.

When the process unit 31 is mounted in the main casing 2, each photosensitive drum 11 contacts the top surface of the upper portion 18A of the conveying belt 18 and confronts the corresponding transfer roller 20 through the upper portion 18A from above. In addition, the cleaning roller 71 opposes the top surface of the upper portion 18A of the conveying belt 18 and confronts the auxiliary roller 34 through the upper portion 18A from above.

Further, the caps 64 on all developer cartridges 41 and the caps 92 on the waste toner box 72 continue to be pressed downward by the corresponding restraining rails 100. Therefore, the developer casings 52 of all developer cartridges 41 and the waste toner box 72 are urged downward while the process unit 31 is mounted in the main casing 2. Accordingly, the developing roller 13 supported in the developer casing 52 of each developer cartridge 41 is urged downward toward the corresponding photosensitive drum 11, and the cleaning roller 71 supported in the cleaning frame 70 on which the waste toner box 72 is mounted is urged downward toward the upper portion 18A of the conveying belt 18.

When removing the process unit 31 from the main casing 2 from this state, the operator first lowers the cover 99 toward the front side to expose the mounting opening 98, as shown in FIG. 2, and subsequently grips the handle 50 on the front side of the process frame 40 and pulls the process unit 31 forward.

More specifically, the process unit 31 is engaged with the guide rails (not shown) in the accommodating space 97 described above by slightly lifting up on the process unit 31 initially from the state in which the photosensitive drums 11 are contacting the conveying belt 18 (see FIG. 2). Next, the operator pulls the process unit 31 forward in a substantially horizontal direction as the process unit 31, positioned over the conveying belt 18 but separated therefrom, is guided on the guide rails (not shown). The operation to remove the process unit 31 from the main casing 2 is complete when the process unit 31 has entirely passed through the mounting opening 98 and is positioned on the front side of the printer 1.

As described above, the process unit 31 is mounted in and removed from the main casing 2 in the front-to-rear direction. Here, the process frame 40 of the process unit 31 need not be completely separated from the main casing 2 (need not be completely detached). Specifically, the process frame 40 may be supported by the guide rails (not shown) in the accommodating space 97 described above so as to be capable of sliding relative to the main casing 2 in the front-to-rear direction. The process frame 40 is capable of sliding between an accommodated position in which the process frame 40 is accommodated in the accommodating space 97 (see FIG. 1) and a withdrawn position in which the process frame 40 has been pulled forward from the accommodating space 97 through the mounting opening 98 (see FIG. 3).

In this case, the process frame 40 is engaged with the above guide rails on the main casing 2 not only in the accommodated position, but also in the withdrawn position, so that the process frame 40 cannot be completely separated from the main casing 2. After pulling the process frame 40 out to the withdrawn position shown in FIG. 3, the operator can mount, remove, or replace developer cartridges 41 relative to the process frame 40. Subsequently, the developer cartridges 41 are mounted in the main casing 2 by moving the process frame 40 back to the accommodated position (see FIG. 1).

3. Contacting/Separating Mechanism

Unless specifically stated otherwise, the following description will assume that the process unit 31 is mounted in the main casing 2.

Figure 8:
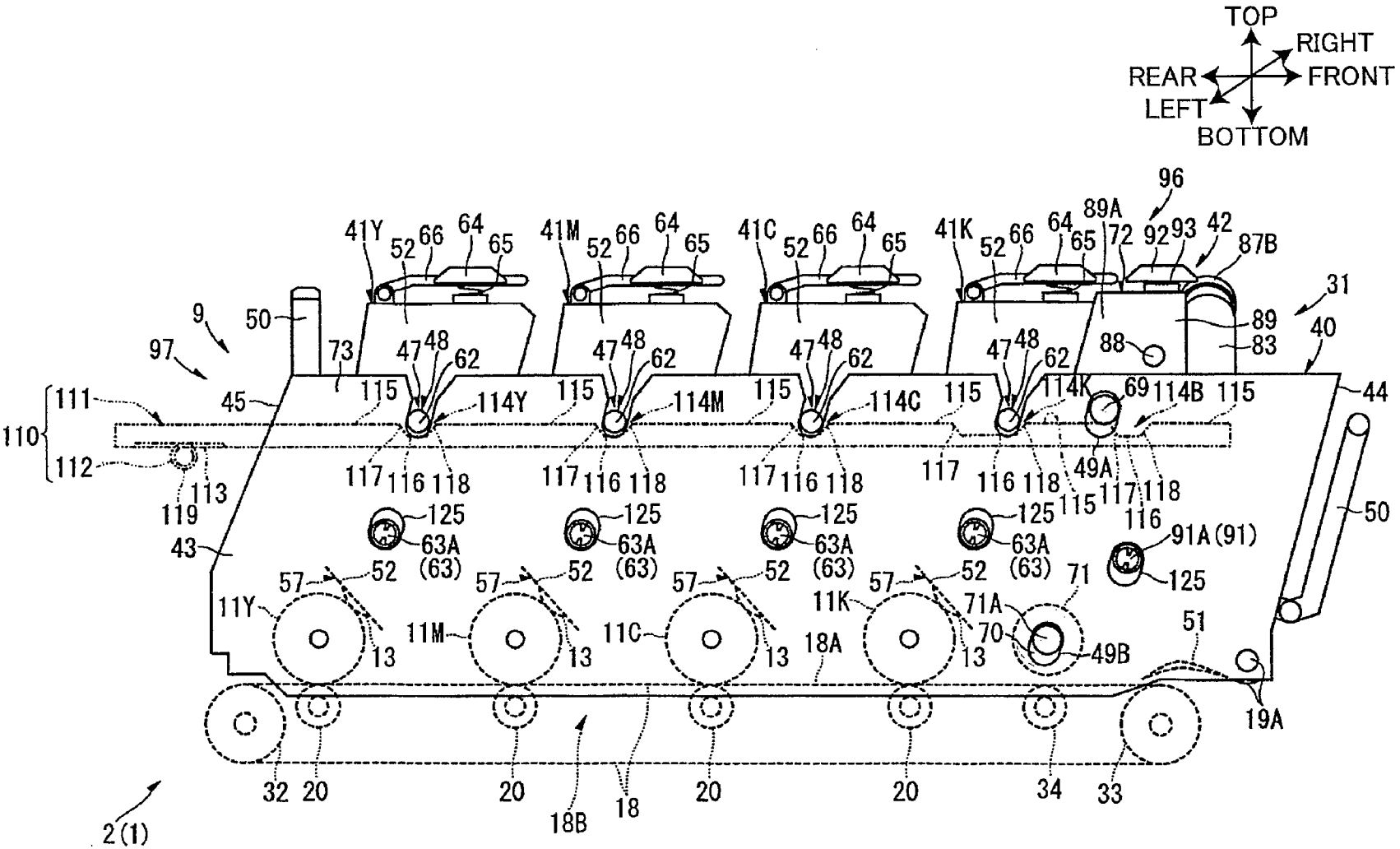
FIG. 8 is a left side view showing the periphery of the process unit during a color image-forming operation according to the embodiment.
Figure 9:
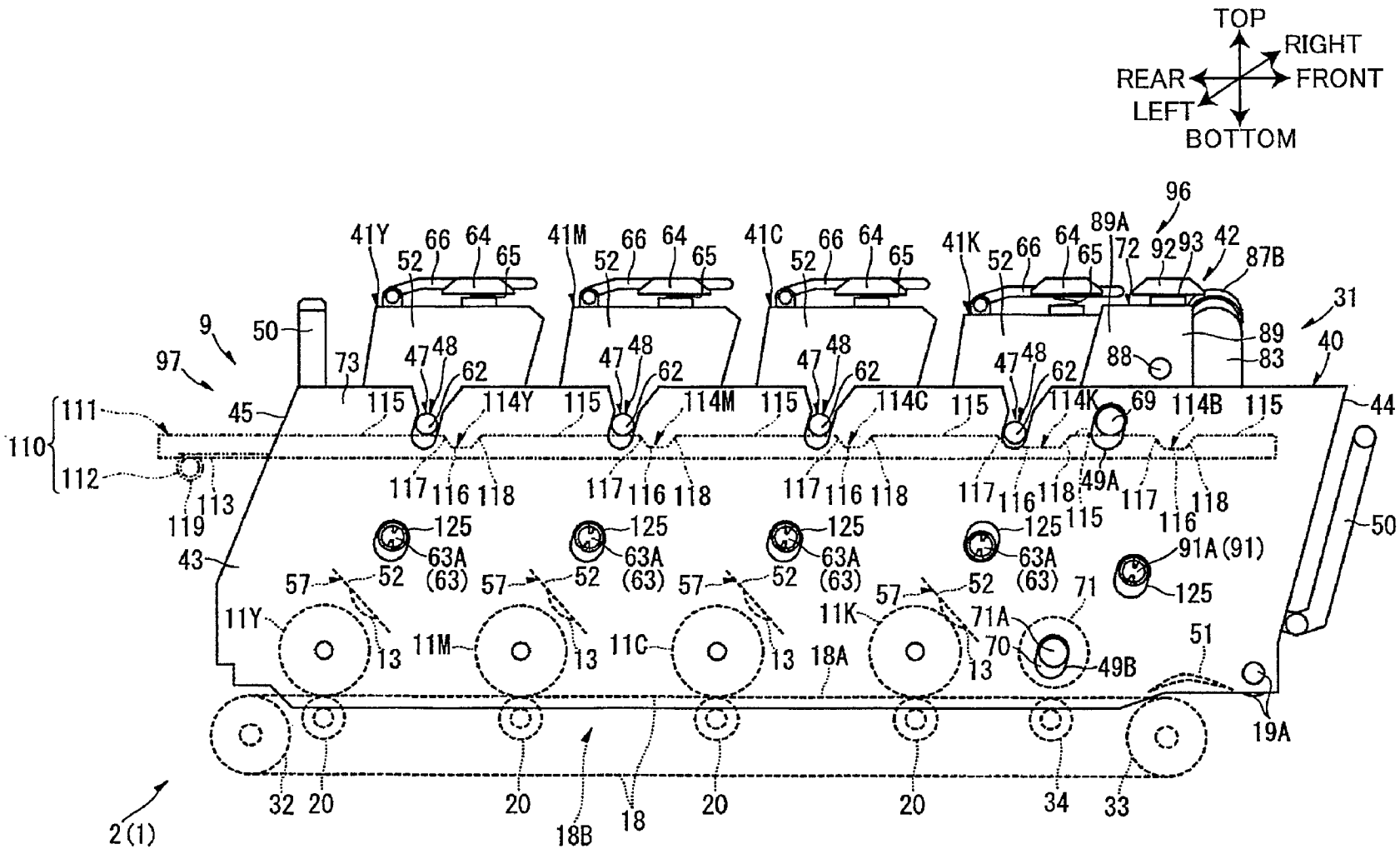
FIG. 9 is a left side view showing the periphery of the process unit during a monochrome image-forming operation according to the embodiment.
Figure 10:
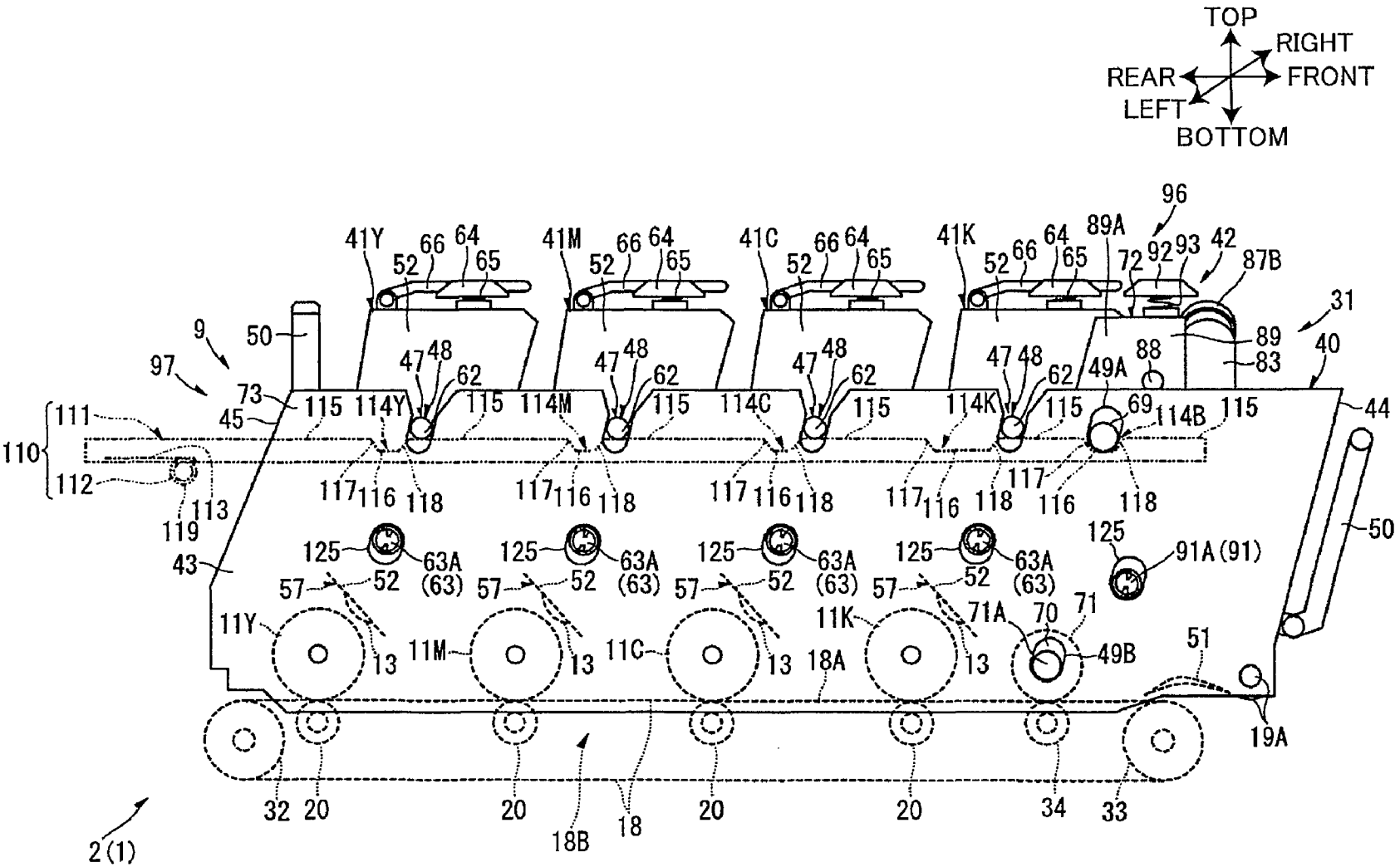
FIG. 10 is a left side view showing the periphery of the process unit during a belt cleaning operation according to the embodiment.

The printer 1 includes the contacting/separating mechanism 110 (see FIGS. 8 through 10). The contacting/separating mechanism 110 is associated with image-forming modes of the printer 1. The image-forming modes are a color mode for forming color images by transferring and superimposing toner images of four colors on a sheet of paper P, as described above, and a monochrome mode for forming black images by transferring only a black toner image to a sheet of paper P.

When the printer 1 is performing image formation in the color mode (color image formation), as shown in FIG. 8, the four developing rollers 13 are in contact with the four corresponding photosensitive drums 11, and a toner image is formed on the surfaces of all photosensitive drums 11 with toner supplied from the corresponding developing rollers 13. When the printer 1 is performing image formation in the monochrome mode (monochrome image formation), as shown in FIG. 9, only the developing roller 13 in the black developer cartridge 41K contacts the black photosensitive drum 11K, while the other developing rollers 13 do not contact the other corresponding photosensitive drums 11. Accordingly, during monochrome image printing, only a black toner image is formed in the process unit 31 by supplying only black toner from the corresponding developing roller 13 to the black photosensitive drum 11K.

As will be described later, the cleaning roller 71 is separated from the top of the conveying belt 18 (see FIGS. 8 and 9) during both color image formation and monochrome image formation so as not to interfere with the sheet of paper P being conveyed on the upper portion 18A of the conveying belt 18.

The printer 1 can also clean the conveying belt 18 (a belt cleaning operation). The belt cleaning operation is performed to remove toner (waste toner) deposited on the outer surface of the conveying belt 18 (the surface that contacts the photosensitive drums 11). When the printer 1 is executing the belt cleaning operation, as shown in FIG. 10, the cleaning roller 71 contacts the top surface of the upper portion 18A on the conveying belt 18 (outer surface of the conveying belt 18). At the same time, all of the developing rollers 13 are separated above the photosensitive drums 11 so that toner carried on the developing rollers 13 is not deposited on the conveying belt 18 via the photosensitive drums 11.

In this way, each developing roller 13 is suitably placed in contact with or separated from the corresponding photosensitive drum 11, and the cleaning roller 71 is suitably placed in contact with or separated from the conveying belt 18 based on when the printer 1 is performing color image formation, monochrome image formation, or belt cleaning. When a developing roller 13 is placed in contact with and separated from the corresponding photosensitive drum 11, the developer cartridge 41 accommodating the developing roller 13 integrally moves with the developing roller 13.

Similarly, when the cleaning roller 71 is placed in contact with and separated from the conveying belt 18, the cleaning frame 70 supporting the cleaning roller 71 and the waste toner box 72 mounted on the cleaning frame 70 move integrally with the cleaning roller 71.

In the following description, the position of the developer cartridge 41 accommodating the developing roller 13 when the developing roller 13 is contacting the corresponding photosensitive drum 11 will be referred to as the contact position (see FIG. 8). When a developer cartridge 41 is in the contact position, the first protrusions 62 provided on the developer cartridge 41 are positioned in the bottom ends of the corresponding cutout parts 48 in the process frame 40. All of the developer cartridges 41 are in the contact position during color image formation, as illustrated in FIG. 8, but only the black developer cartridge 41K is in the contact position during monochrome image formation, as shown in FIG. 9.

On the other hand, the position of a developer cartridge 41 accommodating a developing roller 13 when the developing roller 13 is separated from the corresponding photosensitive drum 11 will be referred to as a separated position (see FIG. 10). When the developer cartridge 41 is in the separated position, the first protrusions 62 provided on the developer cartridge 41 are shifted upward from the bottom ends of the corresponding cutout parts 48 in the process frame 40. All of the developer cartridges 41 are in the separated position during the belt cleaning operation, as shown in FIG. 10, while the three developer cartridges 41 other than the black developer cartridge 41K are in the separated position during monochrome image formation, as shown in FIG. 9.

As shown in FIG. 9, the developer cartridges 41 in the separated position (i.e., all developer cartridges 41 except the black developer cartridge 41K) are positioned higher than when in the contact position (i.e., the position of the black developer cartridge 41K).

In the following description, the position of the cleaning roller 71 when contacting the conveying belt 18 will be referred to as the contact position (see FIG. 10). When the cleaning roller 71 is in the contact position, the center shaft 71A of the cleaning roller 71 is positioned in the lower ends of the corresponding lower guide holes 49B of the process frame 40, and the second protrusions 69 of the cleaning frame 70 are positioned in the lower ends of the corresponding guide holes 49A of the process frame 40.

On the other hand, the position of the cleaning roller 71 when separated from the conveying belt 18 will be referred to as the separated position (see FIGS. 8 and 9). When the cleaning roller 71 is in the separated position, the center shaft 71A of the cleaning roller 71 is positioned in the upper ends of the corresponding lower guide holes 49B, and the second protrusions 69 of the cleaning frame 70 are positioned in the upper ends of the corresponding guide holes 49A.

The cleaning roller 71 is in the contact position during a belt cleaning operation, as shown in FIG. 10, and in the separated position during color image formation and monochrome image formation, as shown in FIGS. 8 and 9.

As shown in FIG. 10, while the cleaning roller 71 in the contact position is contacting the top surface of the upper portion 18A of the conveying belt 18, the four photosensitive drums 11 are also in contact with the top surface of the upper portion 18A, as described earlier. In other words, the photosensitive drums 11 and the cleaning roller 71 in the contact position contact the same surface of the conveying belt 18 (i.e., the top surface of the upper portion 18A).

The contacting/separating mechanism 110 mentioned above appropriately moves the developer cartridges 41 and the cleaning roller 71 to their respective contact positions and separated positions during color image formation, monochrome image formation, and belt cleaning. As described above, when the developer cartridges 41 are mounted in the process frame 40, the left and right ends 13A of the developing roller 13 and the pair of first protrusions 62 on each developer cartridge 41 (see FIGS. 4 through 6) are received in the corresponding first guide grooves 47 of the process frame 40 (see also FIG. 3). Hence, each developer cartridge 41 moves between the lower contact position (see FIG. 8) and the upper separated position (see FIG. 10) along the extended direction of the first guide grooves 47. In other words, the extending direction of the first guide grooves 47 is parallel to the moving direction in which the developer cartridge 41 is mounted into the process frame 40.

As described earlier, the cleaning frame 70 is supported in the process frame 40 at the cleaning roller 71 and second protrusions 69 so as to be capable of sliding along the elongated dimension of the guide holes 49 (the extending direction of the second guide grooves 74). Hence, the cleaning roller 71 supported in the cleaning frame 70 moves between the lower contact position and the upper separated position along the extending direction of the second guide grooves 74.

When the process unit 31 is mounted in the main casing 2, as shown in FIG. 1, the restraining rails 100 provided on the main casing 2 side press downward on the caps 64 provided on all developer cartridges 41 and the caps 92 provided on the waste toner box 72, as described earlier. Consequently, the developer casings 52 of all developer cartridges 41 and the waste toner box 72 are urged downward.

When the developer casings 52 of the developer cartridges 41 are urged downward in this way, the developing rollers 13 supported in the developer casings 52 drops down into contact with the corresponding photosensitive drums 11. Further, by urging the waste toner box 72 downward, the cleaning roller 71 supported in the cleaning frame 70 drops down into contact with the conveying belt 18.

In other words, the restraining rails 100 press against both widthwise ends of the developer cartridges 41 and the waste toner box 72 (specifically, the corresponding caps 64 and caps 92; see FIG. 4), urging the developer cartridges 41 and the cleaning roller 71 toward their respective contact positions.

Next, the contacting/separating mechanism 110 will be described based on the above construction.

As shown in FIGS. 8 through 10, the contacting/separating mechanism 110 includes a pair of translation cams 111, and a motor 112.

As shown in FIG. 8, the translation cams 111 are disposed in the accommodating space 97 of the main casing 2, with one on either widthwise side of the process unit 31 mounted in the main casing 2. Hence, the translation cams 111 are provided on both widthwise sides of the developer cartridges 41 and the cleaning roller 71, provided in the process unit 31. In other wards, each of the translation cams 111 is interposed between the developer cartridges 41 and the cleaning roller 71, and the side plate 43. More specifically, each translation cam 111 is disposed to oppose the bottoms on the parts of the first protrusions 62 and the second protrusion 69 protruding outward from the process frame 40 on the corresponding widthwise side.

Each translation cam 111 is rod-shaped and elongated in the front-to-rear direction, extending substantially in a horizontal direction. Each translation cam 111 is slidably supported in the front-to-rear direction by an inner surface (not shown) of the main casing 2 defining the accommodating space 97 in the width direction. The translation cams 111 move substantially horizontally along a straight line in the front-to-rear direction.

A rack gear 113 is formed in the front-to-rear direction along the bottom surface of each translation cam 111 in the rear end portion thereof.

The top surface of each translation cam 111 is flat and extends substantially along a horizontal plane. Five recess parts 114 (114Y, 114M, 114C, 114K, and 114B) are formed in the top surface of each translation cam 111 at positions forward of the rack gear 113. Specifically, the recess parts 114 are formed at a uniform depth and at prescribed intervals in the front-to-rear direction. Each recess parts 114 penetrates the translation cam 111 in the width direction and, when viewed along the width direction, is shaped substantially like an isosceles trapezoid with the narrow portion on the bottom.

In this way, the top surface of the translation cam 111 is integrally provided with upper horizontal surfaces 115 extending substantially in the horizontal direction at positions in which the recess parts 114 are not formed, and surfaces defining each of the recess parts 114 at positions lower than the upper horizontal surfaces 115.

The surfaces defining each recess parts 114 in the top surface of the translation cam 111 includes a bottom horizontal surface 116 extending in a substantially horizontal direction and defining the deepest part of the corresponding recess parts 114, a rear sloped surface 117 extending along an upward and rearward slope from the rear edge of the bottom horizontal surface 116 to the adjacent upper horizontal surface 115, and a front sloped surface 118 extending along an upward and forward slope from the front edge of the bottom horizontal surface 116 to the adjacent upper horizontal surface 115.

In each translation cam 111, the four recess parts 114 on the rear side correspond to the developer cartridges 41K, 41C, 41M, and 41Y (the photosensitive drums 11K, 11C, 11M, and 11Y) and are distinguished from each other, beginning in order from the rear, as the recess part 114Y, recess part 114M, recess part 114C, and recess part 114K. The remaining recess part 114 (the forwardmost recess part 114) will be referred to as the recess part 114B. The recess parts 114Y, 114M, and 114C are of a size just sufficient for fitting approximately the lower half of the first protrusions 62 on the corresponding developer cartridges 41. The recess parts 114K, on the other hand, are larger than the other recess parts 114 in the front-to-rear direction and are capable of accommodating approximately the lower half of the first protrusions 62 on the black developer cartridge 41K with play in the front-to-rear direction.

The recess parts 114B are of a size just sufficient for fitting approximately the lower half of the second protrusions 69 on the cleaning frame 70 (see FIG. 10). Since the second protrusions 69 have a larger diameter than the first protrusions 62, as described above, the recess parts 114B are larger than the recess parts 114Y, 114M, and 114C in the front-to-rear direction. However, the recess parts 114B are smaller than the recess parts 114K in the front-to-rear direction.

As described above, the five recess parts 114 in each translation cam 111 are formed at intervals in the front-to-rear direction. The intervals between the three rearmost recess parts 114Y, 114M, and 114C is approximately the same as the intervals between the first protrusions 62 on the three rearmost developer cartridges 41Y, 41M, and 41C in the process unit 31 with respect to the front-to-rear direction.

Next, the interval between the third-from-the-rear recess part 114C and the fourth-from-the-rear recess part 114K will be described (hereinafter "third-from-the-rear" and "fourth-from-the-rear" may simply be referred to as "third" and "fourth"). The interval between the recess part 114C and the front edge of the recess part 114K is approximately the same as the interval in the front-to-rear direction between the first protrusion 62 on the third cyan developer cartridge 41C and the first protrusion 62 on the fourth black developer cartridge 41K in the process unit 31. However, the interval between the recess part 114C and the rear edge of the recess part 114K is narrower than the interval between the first protrusions 62 on the cyan developer cartridge 41C and black developer cartridge 41K. In other words, since the recess part 114K is larger than the recess part 114C in the front-to-rear direction, as described above, the bottom horizontal surface 116 of the recess part 114K is correspondingly longer than the bottom horizontal surface 116 of the recess part 114C.

The interval between the fourth recess part 114K and the fifth (forwardmost) recess part 114B is greater than the interval in the front-to-rear direction between the first protrusion 62 on the fourth black developer cartridge 41K and the second protrusion 69 on the cleaning frame 70 disposed adjacent to the front side of the black developer cartridge 41K.

The motor 112 described earlier is provided in the main casing 2. A pinion gear 119 is mounted on the output shaft of the motor 112 and is engaged in the bottom of the rack gear 113 provided on the translation cam 111.

Next, a description will be given for the operations of the contacting/separating mechanism 110 when executing each of a color image-forming operation, monochrome image-forming operation, and belt cleaning operation. For simplification, the following description will assume that the first protrusions 62 of the developer cartridges 41 and the second protrusions 69 of the cleaning frame 70 rest on the bottom horizontal surfaces 116 of the corresponding recess parts 114, though under actual circumstances the first protrusions 62 and second protrusions 69 float slightly above the corresponding bottom horizontal surfaces 116 as illustrated in FIGS. 8 through 10. With this configuration, the restoring force of the compressed springs 65 interposed between the caps 64 and the top surface of the developer casing 52 acts to press the developing rollers 13 against the photosensitive drums 11 rather than being applied to the bottom horizontal surfaces 116 in the translation cam 111. Similarly, the restoring force of the springs 93 acts on the cleaning roller 71.

Initially after mounting the process unit 31 in the main casing 2, the first protrusions 62 on each developer cartridge 41 are fitted into the corresponding recess parts 114 from above and rest on the corresponding bottom horizontal surfaces 116, as illustrated in FIG. 8. At this time, the first protrusions 62 of the black developer cartridge 41K fitted into the recess parts 114K are positioned at the front edge of the recess parts 114K and rest on the front ends of the corresponding bottom horizontal surfaces 116.

The second protrusions 69 of the cleaning frame 70, on the other hand, rest on the upper horizontal surfaces 115 adjacent to the recess parts 114B on the rear side and are not fitted into the recess parts 114B. The position of the translation cams 111 in the front-to-rear direction at this time is referred to as the "home position."

When the pair of translation cams 111 is in the home position, the first protrusions 62 on all developer cartridges 41 rest on the bottom horizontal surfaces 116 of the corresponding recess parts 114 and are positioned at the bottom ends of the cutout parts 48 formed in the corresponding first guide grooves 47 of the process frame 40. Consequently, the developing rollers 13 contact the corresponding photosensitive drums 11 from above so that all developer cartridges 41 are in the contact position.

The second protrusions 69 of the cleaning frame 70, on the other hand, rest on the upper horizontal surfaces 115, positioned higher than the bottom horizontal surfaces 116, and are thereby positioned in the top ends of the corresponding guide holes 49A provided in the process frame 40. Consequently, the cleaning roller 71 supported on the cleaning frame 70 having the second protrusions 69 is in the separated position, separated above the conveying belt 18.

At this time, the four first protrusions 62 and the second protrusion 69 on each widthwise side of the process frame 40 are substantially aligned in the front-to-rear direction such that the height of each protrusion is substantially the same (strictly speaking, the second protrusions 69 resting on the upper horizontal surfaces 115 are positioned slightly higher than the first protrusions 62 resting on the bottom horizontal surfaces 116). Further, the pinion gear 119 on the motor 112 is engaged with the rack gear 113 of the translation cam 111 at approximately the front-to-rear center thereof.

Hence, when the pair of translation cams 111 is in the home position, all developer cartridges 41 are in the contact position while the cleaning roller 71 is in the separated position, allowing for a color image-forming operation.

If the motor 112 is driven while the translation cams 111 are in the home position, the translation cams 111 are slid forward to a "front position" shown in FIG. 9. When the translation cams 111 are in the front position shown in FIG. 9, the pinion gear 119 is engaged with the rear side of the rack gear 113.

When the translation cams 111 are sliding from the home position to the front position, the first protrusions 62 fitted into the three rearmost recess parts 114Y, 114M, and 114C are pushed upward from the rear side by the rear sloped surfaces 117 of the corresponding recess parts 114. Accordingly, the first protrusions 62 in the recess parts 114Y, 114M, and 114C move upward within the cutout parts 48 of the corresponding first guide grooves 47. When the translation cams 111 arrive in the front position, these first protrusions 62 are resting on the upper horizontal surfaces 115 to the rear side of the corresponding rear sloped surfaces 117 (see FIG. 9).

At the same time, when the translation cams 111 arrive in the front position shown in FIG. 9, the first protrusions 62 fitted into the recess parts 114K, which are larger in the front-to-rear direction than the recess parts 114Y, 114M, and 114C, are now positioned at the rear edges of the recess parts 114K and remain fitted therein, resting on the rear ends of the bottom horizontal surfaces 116 constituting the recess parts 114K.

When the translation cams 111 arrive in the front position, the second protrusions 69 continue to rest on the upper horizontal surfaces 115 adjacent to the rear side of the recess parts 114B (specifically, a position on the upper horizontal surfaces 115 further separated from the recess parts 114B than when the translation cams 111 are in the home position).

When the translation cams 111 are in the front position, the first protrusions 62 of the developer cartridges 41Y, 41M, and 41C rest on the upper horizontal surfaces 115, which are positioned higher than the bottom horizontal surfaces 116, and are thus shifted upward from the bottom ends of the cutout parts 48 formed in the corresponding first guide grooves 47. Accordingly, the developer cartridges 41Y, 41M, and 41C are in the separated position that is positioned higher than the contact position when the translation cams 111 are in the home position. Hence, the developing roller 13 in each of the developer cartridges 41Y, 41M, and 41C is separated from the top of the corresponding photosensitive drum 11.

However, since the first protrusions 62 of the black developer cartridge 41K continue to be fitted in the recess parts 114K resting on the bottom horizontal surfaces 116, the first protrusions 62 are positioned at the bottom ends of the cutout parts 48 formed in the corresponding first guide grooves 47. Accordingly, the vertical position of the black developer cartridge 41K does not change; i.e., the black developer cartridge 41K remains in the contact position.

The second protrusions 69 also continue to rest on the upper horizontal surfaces 115 and are positioned at the top ends of the corresponding guide holes 49A in the process frame 40. Hence, the cleaning roller 71 remains in the separated position.

At this time, the four first protrusions 62 and the second protrusion 69 on each widthwise side of the process frame 40 are substantially aligned in the front-to-rear direction such that the height of each protrusion is substantially the same (strictly speaking, the first protrusion 62 of the black developer cartridge 41K resting on the bottom horizontal surfaces 116 is positioned slightly lower than the other protrusions 62 resting on the upper horizontal surfaces 115).

Accordingly, when the pair of translation cams 111 is in the front position, the cleaning roller 71 and all developer cartridges 41 other than the black developer cartridge 41K are in their respective separated positions, while only the black developer cartridge 41K is in the contact position, allowing for a monochrome image-forming operation. When the translation cams 111 in the front position are returned to the home position, all developer cartridges 41 other than the black developer cartridge 41K are returned to their respective contact positions (see FIG. 8).

Next, when the translation cams 111 are in the home position shown in FIG. 8, the motor 112 is driven to slide the pair of translation cams 111 rearward to a rear position shown in FIG. 10. When the translation cams 111 are in the rear position shown in FIG. 10, the pinion gear 119 is engaged in the front end of the rack gear 113.

When the translation cams 111 are sliding from the home position shown in FIG. 8 to the rear position, the first protrusions 62 fitted into the three rearmost recess parts 114Y, 114M, and 114C and the first protrusions 62 fitted into the recess parts 114K and positioned at the front ends thereof are pushed upwardly from the front by the front sloped surfaces 118 of the corresponding recess parts 114. Consequently, the first protrusions 62 fitted into all four recess parts 114Y, 114M, 114C, and 114K move upward within the cutout parts 48 of the corresponding first guide grooves 47. When the translation cams 111 reach the rear position, these first protrusions 62 are resting on the upper horizontal surfaces 115 forward of the corresponding front sloped surfaces 118 (see FIG. 10).

On the other hand, the second protrusions 69 resting on the upper horizontal surfaces 115 reach the recess parts 114B in the front-to-rear direction while the translation cams 111 are sliding rearward into the rear position. At this time, the second protrusions 69 drop into the recess parts 114B and rest on the bottom horizontal surfaces 116 therein, as shown in FIG. 10.

When the translation cams 111 are in the rear position, the first protrusions 62 of all developer cartridges 41 are resting on the upper horizontal surfaces 115, which are positioned higher than the bottom horizontal surfaces 116, thereby shifting the first protrusions 62 upward from the bottom ends of the cutout parts 48. As a result, all developer cartridges 41 are in the separated position that is higher than when the translation cams 111 are in the home position. Hence, the developing rollers 13 in all developer cartridges 41 are separated from the tops of the corresponding photosensitive drums 11.

On the other hand, since the second protrusions 69 have dropped into the recess parts 114B and now rest on the bottom horizontal surfaces 116, as described above, the second protrusions 69 are now positioned in the lower ends of the corresponding guide holes 49A. Accordingly, the cleaning frame 70 on which the second protrusions 69 are provided and the cleaning roller 71 supported on the cleaning frame 70 are positioned lower by the distance that the second protrusions 69 have dropped than when the translation cams 111 are in the home position. At this time, the cleaning roller 71 is in the contact position, contacting the top surface of the conveying belt 18.

At this time, the four first protrusions 62 and the second protrusion 69 on each widthwise side of the process frame 40 are substantially aligned in the front-to-rear direction such that the height of each protrusion is substantially the same (strictly speaking, the second protrusions 69 resting on the bottom horizontal surfaces 116 are positioned slightly lower than the four first protrusions 62 resting on the upper horizontal surfaces 115).

Thus, when the translation cams 111 are in the rear position, all developer cartridges 41 are in the separated position while the cleaning roller 71 is in the contact position, allowing for a belt cleaning operation. When the translation cams 111 are returned from the rear position to the home position, all developer cartridges 41 are returned to the contact position and the cleaning roller 71 is returned to the separated position (see FIG. 8).

As shown in FIGS. 8 through 10, five elongated holes 125 are formed in the left side plate 43 of the process frame 40 for exposing the coupling member 63 of each developer cartridge 41 and the coupling member 91 of the waste toner box 72. Each elongated hole 125 is elongated in the direction in which the developer cartridges 41 and the cleaning roller 71 move between their respective contact positions and separated positions (i.e., the extending direction of the first guide grooves 47 and the second guide grooves 74). Accordingly, all coupling members 63 and the coupling member 91 are exposed in the process frame 40 and can receive a drive force from the main casing 2 side, even when the developer cartridges 41 and cleaning roller 71 move between their respective contact positions and separated positions.

As described above, the translation cams 111 can move linearly between a first location (home position shown in FIG. 8 and front position shown in FIG. 9) in which at least the first protrusions 62 of the black developer cartridge 41K rest on the corresponding bottom horizontal surfaces 116 and the second protrusions 69 rest on the corresponding upper horizontal surfaces 115; and a second location (rear position shown in FIG. 10) in which all first protrusions 62 rest on the corresponding upper horizontal surfaces 115 and the second protrusions 69 rest on the corresponding bottom horizontal surfaces 116. Thus, the developer cartridges 41 and cleaning roller 71 can be moved between their respective contact positions and separated positions through engagements of the corresponding first protrusions 62 and second protrusions 69 by moving the translation cams 111 linearly in the front-to-rear direction (see FIGS. 8 through 10).

During a belt cleaning operation, the conveying belt 18 moves circularly in the counterclockwise in a left side view, as shown in FIG. 10. The cleaning roller 71 in the contact position receives a drive force of a motor provided on the main casing 2 and rotates in a direction opposite the circulating direction of the conveying belt 18. Accordingly, the cleaning roller 71 rubs against the top surface of the upper portion 18A of the conveying belt 18.

A bias is also applied to the cleaning roller 71 at this time. As a result, waste toner deposited on the surface of the conveying belt 18 is transferred onto the outer surface of the cleaning roller 71 from the top surface of the upper portion 18A due to the bias applied to the cleaning roller 71, thereby removing the toner from the surface of the conveying belt 18. In other words, the cleaning roller 71 removes waste toner from the conveying belt 18 in the contact position. The waste toner deposited on the surface of the conveying belt 18 may also include toner that was initially captured by the drum cleaner 14 of each developer cartridge 41 (see FIG. 1) and subsequently expelled back onto the photosensitive drum 11 to be transferred onto the surface of the conveying belt 18.

As shown in FIG. 1, the recovery roller 84 in contact with the cleaning roller 71 rotates in a direction opposite the rotational direction of the cleaning roller 71. A bias is also applied to the recovery roller 84. Hence, the waste toner removed from the conveying belt 18 is transferred from the outer surface of the cleaning roller 71 and collected on the outer surface of the recovery roller 84.

The scraping blade 85 pressed against the front peripheral surface of the recovery roller 84 scrapes off the toner transferred onto the recovery roller 84 as the recovery roller 84 rotates. The toner scraped off the outer surface of the recovery roller 84 by the scraping blade 85 passes through the communicating hole 80 and is collected in the second recovery chamber 79. As illustrated in FIGS. 5 and 6, waste toner accumulated in the second recovery chamber 79 is conveyed leftward in a substantially horizontal direction by the blade of the primary auger 86, introduced through the outlet 81 into the connecting pipe 83 on the front side thereof, and transferred to the lower edge of the blade on the connecting pipe 83 (see also FIG. 1).

The blade of the secondary auger 87 conveys toner received at the bottom end thereof diagonally upward to the right along the slope of the connecting pipe 83 toward the top region of the waste toner box 72. The waste toner conveyed by the secondary auger 87 to the top of the waste toner box 72 is introduced through the inlet 82 and transferred to the right end of the blade on the tertiary auger 88 to the rear of the inlet 82. The blade of the tertiary auger 88 subsequently conveys this toner leftward in a substantially horizontal direction through the waste-toner-accommodating chamber 77 (see also FIG. 1).

Consequently, the waste toner conveyed by the blade of the tertiary auger 88 falls from the tertiary auger 88 in succession beginning from the right side near the inlet 82 and accumulates in the waste-toner-accommodating chamber 77. When the region on the right of the waste-toner-accommodating chamber 77 becomes full of waste toner, the toner is subsequently accumulated in the left region until ultimately the entire chamber is full of waste toner. In this way, in the belt cleaning operation, the waste toner removed from the conveying belt 18 by the cleaning roller 71 is collected in the waste toner box 72 (see FIG. 10).

When the waste-toner-accommodating chamber 77 becomes full of waste toner, the operator removes the process unit 31 from the main casing 2, as shown in FIG. 3. Next, the operator removes the developing unit 96 (the black developer cartridge 41K and the waste toner box 72) from the process frame 40 of the detached process unit 31 and replaces the developing unit 96 with a new developing unit 96 having an empty waste-toner-accommodating chamber 77.

4. Operations and Effects (1) As shown in FIG. 1, the plurality of photosensitive drums 11 in the printer 1 according to this embodiment are disposed in the main casing 2 at positions confronting the conveying belt 18 and are juxtaposed in the front-to-rear direction, which is the direction that the conveying belt 18 conveys sheets of paper P.

The developer cartridges 41, each with a respective developing roller 13, are also juxtaposed in the front-to-rear direction and are capable of moving between the contact position and the separated position. In the contact position shown in FIG. 8, the developing rollers 13 in the developer cartridges 41 are in contact with the corresponding photosensitive drums 11 and supply toner to the photosensitive drums, 11 in order to develop electrostatic latent images on the photosensitive drums 11 into visible images. In the separated position shown in FIG. 10, the developing rollers 13 of the developer cartridges 41 are separated from the corresponding photosensitive drums 11 to prevent toner from being supplied to the photosensitive drums 11.

The cleaning roller 71 provided in the printer 1 is also capable of being moved between the contact position for contacting the conveying belt 18 (see FIG. 10) and the separated position separated from the conveying belt 18 (see FIGS. 8 and 9). In the contact position, the cleaning roller 71 removes waste toner from the conveying belt 18.

As shown in FIG. 3, the printer 1 is provided with the waste toner box 72 for collecting toner that the cleaning roller 71 removes from the conveying belt 18. The waste toner box 72 is slidably supported on the black developer cartridge 41K positioned farthest upstream among the developer cartridges 41 in the conveying direction of the paper P (i.e., the rearward direction). Since the developer cartridges 41 are detachably mounted in the main casing 2, when the waste toner box 72 has reached its limit for accommodating toner removed from the conveying belt 18, the waste toner box 72 can be replaced with a new empty waste toner box 72 by removing the black developer cartridge 41K from the main casing 2. Hence, since maintenance operations for replacing the waste toner box 72 are user-friendly, the operator may be inclined to replace the waste toner box 72 more frequently. With this in mind, the size of the waste toner box 72 may be decreased to achieve a more compact printer 1.

The waste toner box 72, which is slidably supported on the black developer cartridge 41K, can move as a unit with the cleaning roller 71, as shown in FIGS. 8 through 10. In other words, the cleaning roller 71 can move relative to the black developer cartridge 41K. Accordingly, the black developer cartridge 41K can be moved between its contact position and separated position irrespective of the movement of the cleaning roller 71, and conversely the cleaning roller 71 can be moved between its contact position and separated position irrespective of the movement of the black developer cartridge 41K.

Hence, with the construction for supporting the waste toner box 72 on the black developer cartridge 41K in this embodiment described above, the black developer cartridge 41K and the cleaning roller 71 can be moved independently to respective desired positions.

Since the conveying belt 18 conveys the paper P in a rearward direction in this embodiment described above, the black developer cartridge 41K supporting the waste toner box 72 is positioned farthest upstream in this conveying direction among the four developer cartridges 41. If the direction for conveying the paper P were in a forward direction, the black developer cartridge 41K could be positioned on the downstream side in the conveying direction, with the waste toner box 72 supported on the developer cartridge 41 farthest downstream in the conveying direction.

(2) As shown in FIG. 7, the guide recesses 94A and 94B elongated in the direction that the waste toner box 72 is moved are formed in the waste toner box 72, while the guide protrusions 95A and 95B are loosely fitted in the guide recesses 94A and 94B are provided in the developer casing 52 of the black developer cartridge 41K. Hence, by simply providing these guide recesses 94A and 94B and guide protrusions 95A and 95B, a simple construction can be implemented for slidably supporting the waste toner box 72 on the developer cartridge 41 (developer casing 52).

Further, the pair of the guide recesses 94 (i.e. left side guide recesses 94 and right side guide recesses 94) are aligned in the width direction orthogonal to the direction in which the waste toner box 72 moves, and guide protrusions 95A and 95B are loosely fitted into the guide recesses 94A and 94B. Therefore, the waste toner box 72 is supported on the developer casing 52 of the developer cartridge 41 at two locations in the width direction (i.e. the left side and right side of the developer casing 52) and can thus slide with more stability than when supported at just one location. Further, a plurality (two in this embodiment) of the guide recesses 94A and 94B is formed in the moving direction of the waste toner box 72, with guide protrusions 95A and 95B loosely fitted into each guide recess 94A and 94B. Accordingly, the waste toner box 72 can slide with even greater stability.

In this embodiment described above, the guide recesses 94A and 94B are formed in the waste toner box 72, and the guide protrusions 95A and 95B are provided on the black developer cartridge 41K. However, it is possible to conversely provide the guide protrusions 95A and 95B on the waste toner box 72 and form the guide recesses 94A and 94B in the black developer cartridge 41K. In this case, the guide protrusions 95A and 95B are provided on the inner widthwise surfaces of the protruding parts 89A constituting the waste toner box 72 and protrude inward in the width direction, while the guide recesses 94A and 94B are formed in the left and right side surfaces of the developer casing 52 of the black developer cartridge 41K in regions opposing the inner widthwise surfaces of the protruding parts 89A and are recessed inwardly in the width direction. The guide protrusions 95A and 95B on the waste toner box 72 are then loosely fitted into the corresponding guide recesses 94A and 94B of the developer casing 52.

(3) Since the guide protrusions 95A and 95B are rotatable rollers, the guide protrusions 95A and 95B can move smoothly in the guide recesses 94A and 94B when sliding the waste toner box 72 so as not to interfere with this sliding.

(4) As shown in FIG. 10, the first protrusions 62 are provided on each developer cartridge 41, protruding from both sides of the developer cartridge 41 in the width direction, which is the axial direction of the developing roller 13. Further, the second protrusions 69 protrude outward in the width direction, the positions of the second protrusions 69 are fixed relative to the cleaning roller 71.

The pair of photosensitive drums 11 are provided one on either widthwise side of the developer cartridges 41 and the cleaning roller 71. The developer cartridges 41 and the cleaning roller 71 are moved between their respective contact positions and separated positions through engagements of the corresponding first protrusions 62 and second protrusions 69 by moving the translation cams 111 linearly in the front-to-rear direction.

By using just the translation cams 111 to move the developer cartridges 41 and the cleaning roller 71, it is possible to reduce the number of parts required in the structure for moving the developer cartridges 41 and the cleaning roller 71.

(5) Since the first protrusions 62 and the second protrusions 69 are aligned in the front-to-rear direction, the translation cams 111 that linearly move in the front-to-rear direction can be formed in a long slender shape extending in the front-to-rear direction, thereby requiring a relatively small space in the main casing 2 for accommodating the translation cams 111, making it possible to produce a more compact printer 1. Here, the front-to-rear direction is the same direction in which the process unit 31 is mounted in and removed from the main casing 2 (see FIG. 3). By aligning the first protrusions 62 and the second protrusions 69 in the direction that the process unit 31 is mounted and removed, there are fewer parts on the process unit 31 that can catch on the main casing 2 when the process unit 31 is mounted and removed, thereby facilitating smooth mounting and removal of the process unit 31.

(6) Each developer cartridge 41 is detachably mounted in the process frame 40, which retains the photosensitive drums 11. When mounting the developer cartridge 41 in the process frame 40, the first guide grooves 47 formed in the process frame 40 guide the ends of the first protrusions 62 protruding outward from the developer cartridge 41 in the width direction (see FIG. 3). Accordingly, the first protrusions 62, which are engaged with the translation cams 111 for moving the developer cartridges 41 between the contact positions shown in FIG. 8 and the separated positions shown in FIG. 10, also serve as members guided in the first guide grooves 47 for smoothly mounting the developer cartridges 41 in removing the developer cartridges 41 from the process frame 40.

When the developer cartridge 41 is mounted in the process frame 40, the first protrusions 62 are received in the first guide grooves 47. Since the first guide grooves 47 extend along the direction that the developer cartridge 41 moves during mounting, after the developer cartridge 41 is mounted in the process frame 40, the developer cartridge 41 can move smoothly between the contact position shown in FIG. 8 and the separated position shown in FIG. 10, while the first protrusions 62 remain in the first guide grooves 47.

(7) Since the process frame 40 is capable of sliding relative to the main casing 2, as shown in FIG. 3, the plurality of developer cartridges 41 mounted in the process frame 40 can be removed altogether from the main casing 2 for replacement by sliding the process frame 40 out of the main casing 2. Hence, this construction is user-friendly.

(8) By providing the printer 1 with the cleaning frame 70 for supporting the cleaning roller 71 and providing the second protrusions 69 on the cleaning frame 70, the positions of the second protrusion 69 relative to the cleaning roller 71 can be fixed reliably.

The cleaning frame 70 is capable of sliding in the direction that the cleaning roller 71 moves, with respect to the process frame 40 by the cleaning roller 71 and the second protrusions 69. In other words, the cleaning frame 70 is supported on the process frame 40 at two locations, the cleaning roller 71 and the second protrusions 69 (four locations when considering both widthwise sides), thereby achieving better stability for sliding than if the cleaning frame 70 were supported only one location. Accordingly, the cleaning roller 71 supported in the cleaning frame 70 can move smoothly between the contact position shown in FIG. 10 and the separated position shown in FIGS. 8 and 9.

(9) Through a simple construction of providing only upper horizontal surfaces 115 and bottom horizontal surfaces 116 in each translation cam 111, as illustrated in FIGS. 8 through 10, the developer cartridges 41 can be placed in the separated position by resting the first protrusions 62 on the corresponding upper horizontal surfaces 115 (see FIG. 10) and can be placed in the contact position by resting the first protrusions 62 on the corresponding bottom horizontal surfaces 116 (see FIG. 8). Further, the cleaning roller 71 can be placed in the separated position by resting the second protrusions 69 on the corresponding upper horizontal surfaces 115 (see FIG. 8) and can be placed in the contact position by resting the second protrusions 69 on the corresponding bottom horizontal surfaces 116 (see FIG. 10).

(10) The translation cams 111 can be moved between the first position shown in FIGS. 8 and 9 and the second position shown in FIG. 10.

When the translation cams 111 are in the first position shown in FIGS. 8 and 9, the first protrusions 62 of the developer cartridges 41 (at least the black developer cartridge 41K) rest on the corresponding bottom horizontal surfaces 116 and the second protrusions 69 rest on corresponding upper horizontal surfaces 115. In this position, the developer cartridges 41 (at least the black developer cartridge 41K) are in the contact position and the cleaning roller 71 is in the separated position. Accordingly, the printer 1 can perform image formation by developing electrostatic latent images on the photosensitive drums 11 into toner images and transmitting these toner images onto a sheet of paper P conveyed by the conveying belt 18. Since the cleaning roller 71 is in the separated position and is separated from the conveying belt 18, the cleaning roller 71 does not interfere with the conveying belt 18 conveying the sheet of paper P.

When the translation cam 111 is in the second position shown in FIG. 10, all first protrusions 62 rest on corresponding upper horizontal surfaces 115, and the second protrusions 69 rest on corresponding bottom horizontal surfaces 116. Thus, all developer cartridges 41 are in the separated position and the cleaning roller 71 is in the contact position. Accordingly, the cleaning roller 71 contacts the conveying belt 18 and can remove unnecessary toner therefrom. Placing all developer cartridges 41 in the separated position with the developing rollers 13 separated from the corresponding photosensitive drums 11 prevents the developing rollers 13 from supplying toner to the photosensitive drums 11. Accordingly, the photosensitive drums 11 will not supply toner to the conveying belt 18 when the cleaning roller 71 is in the process of removing toner therefrom.

Hence, a simple construction involving only moving the translation cams 111 between the first and second positions can be employed to switch the printer 1 between operations for image formation and operations for cleaning the conveying belt 18.

(11) As shown in FIG. 1, the restraining rails 100 press down on both widthwise ends (the caps 64 and 92) of the developer cartridges 41 and the waste toner box 72 so that the developer cartridges 41 and the cleaning roller 71 are urged into their respective contact positions (see FIGS. 8 through 10). In this way, the positions of the developer cartridges 41 and the cleaning roller 71 can be each set to the contact position, making it possible to clearly understand the positions of the developer cartridges 41 and the cleaning roller 71. Further, since the restraining rails 100 press down on both widthwise ends of the developer cartridge 41 and the waste toner box 72 (see FIG. 4), both the developer cartridges 41 and the waste toner box 72 are urged toward their respective contact positions while in a stabilized state.

(12) As shown in FIG. 6, the secondary auger 87 extends in a direction sloped upward to the horizontal plane for conveying toner removed from the conveying belt 18 toward the top portion of the waste toner box 72 along this sloped direction. Therefore, the secondary auger 87 can convey toner to the top of the waste toner box 72 smoothly and more reliably than when conveying toner along a directly vertical path even if the toner (and particularly polymeric toner with excellent fluidity) can easily spill off the blade and fall downward.

(13) As shown in FIGS. 5 and 6, the primary auger 86 extends in a substantially horizontal direction for conveying toner removed from the conveying belt 18 in a substantially horizontal direction toward the bottom end of the secondary auger 87 (the outlet 81). The secondary auger 87 conveys the toner received from the primary auger 86 at the bottom end of the secondary auger 87 toward the top of the secondary auger 87 in a sloped direction that slopes upward from the horizontal plane. The tertiary auger 88 extends substantially horizontally in the top area of the waste toner box 72 and functions to convey toner received at the top end of the secondary auger 87 in a substantially horizontal direction so that the toner falls and accumulates in the waste-toner-accommodating chamber 77 of the waste toner box 72 (see FIG. 5) successively from the side near the top end of the secondary auger 87 (the inlet 82).

In other words, if toner is collected in the waste toner box 72 from the top of the waste toner box 72 using the secondary auger 87 extending in the sloped direction, providing the primary auger 86 and tertiary auger 88 ensures that toner removed from the conveying belt 18 is smoothly collected in the waste toner box 72. Further, use of the primary auger 86, secondary auger 87, and tertiary auger 88 actively collects waste toner in the waste toner box 72, thereby improving the efficiency for collecting waste toner in the waste toner box 72.

(14) As shown in FIG. 3, the developer cartridges 41 are detachably mounted in the main casing 2 of the printer 1. Further, the black developer cartridge 41K includes the developer casing 52 for supporting the developing roller 13 and the waste toner box 72 disposed in confrontation with the developer casing 52 for collecting unnecessary toner removed from the conveying belt 18 (see FIG. 4). By detachably mounting the black developer cartridge 41K in the main casing 2, the waste toner box 72 can be replaced with an empty waste toner box 72 upon reaching its capacity for accommodating waste toner, thereby making this construction user-friendly.

The waste toner box 72 is slidably supported on the developer casing 52 of the black developer cartridge 41K (see FIG. 7). Further, as shown in FIGS. 8 through 10, the cleaning roller 71 is provided in the waste toner box 72 for removing toner from the conveying belt 18 and is capable of moving into contact with or separating from the conveying belt 18. Hence, in this case, the waste toner box 72 can move integrally with the cleaning roller 71 and relative to the developer casing 52 of the black developer cartridge 41K when the black developer cartridge 41K is mounted in the main casing 2. Conversely, the developer casing 52 of the black developer cartridge 41K can move irrespective of the movements of the cleaning roller 71 and waste toner box 72.

Hence, when the black developer cartridge 41K is configured as described above for supporting the waste toner box 72 on the developer casing 52 thereof, the developer casing 52 of the black developer cartridge 41K and the cleaning roller 71 can be moved independently to their respective desired positions.

(15) As shown in FIG. 1, the developing roller 13 and the recovery roller 84 of the black developer cartridge 41K (developing unit 96) are disposed at one end side (the bottom end side) relative to the sliding directions of the developer casing 52 and the waste toner box 72. In this way, the developing roller 13 of the developer casing 52 and the recovery roller 84 of the waste toner box 72 can be disposed together in the black developer cartridge 41K. Hence, the developing roller 13 and the recovery roller 84, and more generally the developer casing 52 and the waste toner box 72, can be disposed together on the same side of the conveying belt 18 (the upper portion 18A side). This configuration reduces the space required for providing the black developer cartridge 41K (developing unit 96 in the main casing 2.

(16) The process frame 40 may be integrally provided in the main casing 2 (construction not shown). In this case, the photosensitive drums 11 retained in the process frame 40 can be positioned precisely relative to the main casing 2 (see FIG. 1). Further, the developer cartridges 41 and the waste toner box 72 are detachably mounted in the process frame 40 on the main casing 2 side through the top, by providing an opening in the top surface of the main casing 2, for example (see FIG. 1).

(17) By detachably mounting the waste toner box 72 on the cleaning frame 70, the waste toner box 72 is disposed near the cleaning roller 71 supported in the cleaning frame 70, as shown in FIG. 1. Accordingly, the waste toner box 72 can collect toner that the cleaning roller 71 removes from the conveying belt 18 without toner leakage.

In the printer 1 having the above construction, the cleaning roller 71 is positioned lower than the developer cartridges 41. By employing a nested structure in which the waste toner box 72 is accommodated in the cleaning frame 70, which in turn is provided in the process frame 40, and by providing the second protrusions 69 on the top edge of the cleaning frame 70 supporting the cleaning roller 71 (see FIG. 3), the second protrusions 69 can be set to approximately the same height (vertical position) as the first protrusions 62 on the developer cartridges 41 so that the first protrusions 62 and second protrusions 69 are aligned in the front-to-rear direction, as shown in FIGS. 8 through 10.

Accordingly, by sliding the pair of translation cams 111, the developer cartridges 41 and cleaning roller 71 can be moved individually through engagements of the translation cam 111 with the first protrusions 62 on the four developer cartridges 41 and the second protrusion 69 fixed in position relative to the cleaning roller 71. Since the first protrusions 62 and second protrusion 69 are disposed at the top edge of the process frame 40, the translation cam 111 engaged with the first protrusions 62 and second protrusion 69 can also be disposed along the top edge of the process frame 40, thereby effectively utilizing the area below the top edge of the process frame 40 for maximum space between the widthwise sides of the process frame 40.

(18) As shown in FIG. 3, second guide grooves 74 are formed in the cleaning frame 70 for guiding the center shaft 84A of the recovery roller 84 protruding outward in the widthwise direction from the waste toner box 72 when mounting the waste toner box 72 in the cleaning frame 70. Hence, the waste toner box 72 can be smoothly mounted in the sloped wall 7 as the center shaft 84A is guided in the second guide grooves 74.

The second guide grooves 74 extend parallel to the first guide grooves 47, which serve to guide the first protrusions 62 on the developer cartridges 41 (see FIG. 4) when mounting the developer cartridges 41 in the process frame 40. Hence, the waste toner box 72 and the black developer cartridge 41K can be moved in the same direction when mounting the waste toner box 72 in the cleaning frame 70 and when mounting the black developer cartridge 41K supporting the waste toner box 72 in the process frame 40, thereby achieving smoother mounting of the waste toner box 72 and black developer cartridge 41K.

(19) Since the plurality of photosensitive drums 11 and the cleaning roller 71 in the contact position contact the same surface of the conveying belt 18 (the top surface of the upper portion 18A), the plurality of photosensitive drums 11 and the cleaning roller 71 can be disposed in the main casing 2 together on the same side of the conveying belt 18, thereby effectively utilizing space in the main casing 2 and making it possible to produce a more compact printer 1. Further, since the surface of the conveying belt 18 contacted by the plurality of photosensitive drums 11 and the cleaning roller 71 can be made flat, the conveying belt 18 can smoothly convey sheets of paper P along this flat surface.

5. Modifications of the Embodiment

In this embodiment described above, the printer has a configuration for forming electrostatic latent images on the photosensitive drums 11 by exposing the photosensitive drums 11 with the laser beams B, as shown in FIG. 1. However, the present invention may be applied to a printer configured to expose the photosensitive drums 11 with LED light and to all types of image-forming devices that use a conveying belt to convey sheets of paper.

Further, the cleaning roller 71 may be configured of a brush or the like, and is not limited to a roller member.

Further, the drum unit 46 described above with reference to FIG. 3 (i.e., the integrated structure including the photosensitive drum 11, charger 12, and drum cleaner 14) may be integrally provided with the corresponding developer cartridge 41 to construct a process cartridge. In this case, the developer cartridge 41 of the process cartridge can move relative to the drum unit 46, and the developing roller 13 contacts and separates from the photosensitive drum 11 through the relative movement of the developer cartridge 41.

The photosensitive drum 11 may also be retained in the developer cartridge 41 rather than the process frame 40, and the developer cartridge 41 and the photosensitive drum 11 may be detachably mounted in the process frame 40 as a unit.

Further, the cleaning roller 71 may be provided in the waste toner box 72 rather than the cleaning frame 70. In this case, the cleaning roller 71 is replaced with the waste toner box 72.

According to the above described embodiment, The process frame 40 is movable in the front-to-rear direction relative to the main casing 2 and is capable of being pulled out of the main casing 2. However, the process frame 40 may not be capable of being pulled out of the main casing 2. In this case, the main casing 2 may have a top cover positioned at an upper portion and pivotally movably provided. The mounting and removing of the developing cartridges 41 and the waste toner box 72 may be conducted through the top cover. If the mounting and removing of the developing cartridges 41 and the waste toner box 72 is performed through the top cover, the process frame 40 may be integrally provided on the main casing 2.

What is claimed is:

1. An image-forming apparatus comprising:

a main casing;

a conveying unit configured to convey a recording medium in a conveying direction;

a plurality of photosensitive bodies juxtaposed in the conveying direction and confronting the conveying unit;

a plurality of developing units detachably mountable on the main casing, each of the developing units being configured to move between a first position where the developing unit is capable of supplying developer to a corresponding photosensitive drum and a second position where the developing unit separates from the corresponding photosensitive drum;

a cleaning member configured to move between a third position where the cleaning member is capable of collecting a waste developer deposited on the conveying unit and a fourth position where the cleaning member separates from the conveying unit; and a receptacle slidably supportable on one of the developing units and configured to accommodate the collected waste developer collected by the cleaning member, the cleaning member configured to move integrally with the receptacle between the third position and the fourth position, the receptacle and the one of the developing units being integrally and detachably mountable on the main casing.

2. The image-forming apparatus according to claim 1, wherein one of the receptacle and the one of the developing units is formed with a pair of holes, each of the pair of holes being elongated in a direction in which the receptacle slides, wherein the other one of the receptacle and the one of the developing units is provided with a pair of protrusions which are configured to loosely fit in the pair of holes, respectively.

3. The image-forming apparatus according to claim 2, wherein the protrusions are rollers that are rotatably supportable on the other one of the receptacle and the one of the developing units.

4. The image-forming apparatus according to claim 1, further comprising:

a pair of first protrusions provided on each of the developing units and configured to protrude outward from both end portions of each developing unit in an axial direction of the photosensitive bodies, respectively;

a pair of second protrusions extending in the axial direction, each of the second protrusions being positioned on each side of the cleaning member in the axial direction, the positions of the second protrusions being fixed relative to the cleaning member, wherein one first protrusion of the pair of first protrusions for each developing unit and one second protrusion of the pair of second protrusions is positioned at one side in the axial direction and another first protrusion of the pair of first protrusions for each developing unit and another second protrusion of the pair of second protrusions is positioned at another side in the axial direction; and a pair of translation members positioned at both sides of the photosensitive bodies and the cleaning member in the axial direction, respectively, and movable in the conveying direction, one translation member of the pair of translation members being engaged with the one first protrusion and the one second protrusion, another translation member of the pair of translation members being engaged with the other first protrusion and the other second protrusion, the plurality of developing units being configured to move between the first position and the second position by movement of the pair of translation members, and the cleaning member being configured to move between the third position and the fourth position by the movement of the pair of translation members.

5. The image-forming apparatus according to claim 4, wherein the one first protrusion and the one second protrusion are aligned in the conveying direction, and the other first protrusion and the other second protrusion are aligned in the conveying direction.

6. The image-forming apparatus according to claim 4, further comprising a holding member configured to hold the photosensitive bodies and to detachably mount the developing units, and wherein the holding member is formed with grooves that extend in a moving direction of the developing units and that are configured to guide the first protrusions of each developing unit when mounting and removing the developing units on and from the holding member.

7. The image-forming apparatus according to claim 6, wherein the holding member is configured to be pulled out of the main casing.

8. The image-forming apparatus according to claim 6, further comprising a supporting member configured to support the cleaning member and, wherein the supporting member is provided with the pair of second protrusions, the supporting member being slidably supportable on the holding member in a moving direction of the cleaning member through the cleaning member and the second protrusions.

9. The image-forming apparatus according to claim 6, wherein each of the translation members includes:

first parts configured to fix positions of the developing units to the second positions when the pair of first protrusions of each of the developing units rest on the first part, second parts configured to fix positions of the developing units to the first position when the pair of first protrusions of each of the developing units rest on the second part, a third part configured to fix a position of the cleaning member to the fourth position when the pair of second protrusions rest on the third part, and a fourth part configured to fix a position of the cleaning member to the third position when the pair of second protrusions rest on the fourth part.

10. The image-forming apparatus according to claim 9, wherein the each of the translation members is configured to move between a first location where the first protrusions rest on the second parts, respectively, and the second protrusions rest on the third part, and a second location where the first protrusions rest on the first parts, respectively, and the second protrusions rest on the fourth part.

11. The image-forming apparatus according to claim 4, further comprising urging members configured to urge the developing units and the cleaning member toward the first position and the third position, respectively.

12. The image-forming apparatus according to claim 1, further comprising a first developer conveying member that extends in a sloped direction sloping upward relative to a horizontal plane and that is configured to convey the collected waste developer collected by the cleaning member to an upper region of the receptacle along the sloped direction.

13. The image-forming apparatus according to claim 12, wherein the first developer conveying member has an upper end portion and a lower end portion, and further comprising:

a second developer conveying member that extends in a horizontal direction and is configured to convey the collected waste developer collected by the cleaning member to the lower end portion of the first developer conveying member in the horizontal direction; and a third developer conveying member that extends in the horizontal direction, is positioned at the upper region of the receptacle, and is configured to convey the conveyed waste developer conveyed by the first developer conveying member to the upper end portion of the first developer conveying member, in the horizontal direction, thereby causing the conveyed waste developer to fall from the third developer conveying member in succession beginning from a side near the upper end portion of the first developer conveying member and to accumulate in the receptacle.

14. A developing unit detachably mountable in a main casing of an image-forming apparatus, the image-forming apparatus comprising a conveying unit that conveys a recording medium, the developing unit comprising:

a developer casing;

a developer carrying member that is supported on the developer casing;

a receptacle that is slidably supportable on the developer casing and configured to accommodate a waste developer collected from the conveying unit, wherein the receptacle comprises a recovery member configured to recover the waste developer collected from the conveying unit to accommodate the waste developer in the receptacle, and wherein each of the developer casing and the receptacle has one end side in a sliding direction in which the receptacle slides, and wherein each of the developer carrying member and the recovery member is disposed at one end side of each of the developer casing and the receptacle.

15. The developing unit according to claim 14, wherein one of the receptacle and the developer casing is formed with a pair of holes, each of the pair of holes being elongated in a sliding direction in which the receptacle slides, and wherein the other one of the receptacle and the developer casing is provided with a pair of protrusions configured to loosely fit in the pair of holes, respectively.

16. The developing unit according to claim 15, wherein the protrusions are rollers that are rotatably supportable on the other one of the receptacle and the developer casing.

17. The developing unit according to claim 14, further comprising a first developer conveying member that extends in a sloped direction sloping upward relative to a horizontal plane and that is configured to convey the collected waste developer collected from the conveying member to an upper region of the receptacle along the sloped direction.

18. The image-forming apparatus according to claim 17, wherein the first developer conveying member has an upper end portion and a lower end portion, and further comprising:

a second developer conveying member that extends in a horizontal direction and is configured to convey the collected waste developer collected from the conveying member to the lower end portion of the first developer conveying member in the horizontal direction; and a third developer conveying member that extends in the horizontal direction, is positioned at the upper region of the receptacle, and is configured to convey the conveyed waste developer conveyed by the first developer conveying member to the upper end portion of the first developer conveying member, in the horizontal direction, thereby causing the conveyed waste developer to fall from the third developer conveying member in succession beginning from a side near the upper end portion of the first developer conveying member and to accumulate in the receptacle.

19. An image-forming apparatus comprising:

a main casing;

a conveying unit configured to convey a recording medium in a conveying direction;

a plurality of photosensitive bodies juxtaposed in the conveying direction and confronting the conveying unit;

a plurality of developing units detachably mountable on the main casing, each of the developing units being configured to move between a first position where the developing unit is capable of supplying developer to a corresponding photosensitive drum and a second position where the developing unit separates from the corresponding photosensitive drum;

a cleaning member configured to move between a third position where the cleaning member is capable of collecting a waste developer deposited on the conveying unit and a fourth position where the cleaning member separates from the conveying unit;

a pair of first protrusions provided on each of the developing units and protrudes outward from both end portions of each developing unit in an axial direction of the photosensitive bodies, respectively;

a pair of second protrusions extending in the axial direction, each of the second protrusions being positioned on a side of the cleaning member in the axial direction, the positions of the second protrusions being fixed relative to the cleaning member, wherein one first protrusion of the pair of first protrusions for each developing unit and one second protrusion of the pair of second protrusions is positioned at one side in the axial direction and another first protrusion of the pair of first protrusions for each developing unit and another second protrusion of the pair of second protrusions is positioned at another side in the axial direction; and a pair of translation members positioned at both sides of the photosensitive bodies and the cleaning member in the axial direction, respectively, and movable in the conveying direction, wherein one translation member of the pair of translation members is configured to engage with the one first protrusion and the one second protrusion, wherein the other translation member of the pair of translation members is configured to engage with the other first protrusion and the other second protrusion, the plurality of developing units being configured to move between the first position and the second position by movement of the pair of translation members, and the cleaning member being configured to move between the third position and the fourth position by the movement of the pair of translation members.

20. The image-forming apparatus according to claim 19, wherein the one first protrusion and the one second protrusion are aligned in the conveying direction, and the other first protrusions and the other second protrusion are aligned in the conveying direction.

21. The image-forming apparatus according to claim 19, further comprising a holding member configured to hold the photosensitive bodies and to detachable mount the developing units, and wherein the holding member is formed with first grooves that extend in a moving direction of the developing units and that are configured to guide the first protrusions of each developing units when mounting and removing the developing units from the holding member.

22. The image-forming apparatus according to claim 21, wherein the holding member is configured to be pulled out of the main casing.

23. The image-forming apparatus according to claim 21, wherein the holding member is integrally provided on the main casing.

24. The image-forming apparatus according to claim 21, further comprising a supporting member configured to support the cleaning member and, wherein the supporting member is provided with the pair of second protrusions, the supporting member being slidably supportable on the holding member in a moving direction of the cleaning member through the cleaning member and the second protrusions.

25. The image-forming apparatus according to claim 24, further comprising a receptacle configured to be supported on one of the developing units and to accommodate the collected waste developer collected by the cleaning member, the receptacle being detachably mountable on the supporting member.

26. The image-forming apparatus according to claim 25, wherein the receptacle is provided with a pair of projection portions projecting outward from both edge portions of the receptacle in the axial direction, respectively, and wherein the supporting member is formed with second grooves that extend parallel to the first grooves and that are configured to guide the projections of the receptacle when mounting and removing the receptacle on and from the supporting member.

27. The image-forming apparatus according to claim 25, further comprising urging members configured to urge the developing units and the cleaning member toward the first positions and the third position, respectively.

28. The image-forming apparatus according to claim 19, further comprising a first developer conveying member that extends in a sloped direction sloping upward relative to a horizontal plane and that is configured to convey the collected waste developer collected by the cleaning member to an upper region of the receptacle along the sloped direction.

29. The image-forming apparatus according to claim 28, wherein the first developer conveying member has an upper end portion and a lower end portion, and further comprising:

a second developer conveying member that extends in a horizontal direction and is configured to convey the collected waste developer collected by the cleaning member to the lower end portion of the first developer conveying member in the horizontal direction; and a third developer conveying member that extends in the horizontal direction, is positioned at the upper region of the receptacle, and is configured to convey the conveyed waste developer conveyed by the first developer conveying member to the upper end portion of the first developer conveying member, in the horizontal direction, thereby causing the conveyed waste developer to fall from the third developer conveying member in succession beginning from a side near the upper end portion of the first developer conveying member and to accumulate in the receptacle.

30. The image-forming apparatus according to claim 19, wherein each of the translation members includes:

first parts configured to fix positions of the developing units to the second positions when the pair of first protrusions of each of the developing units rest on the first part, second parts configured to fix positions of the developing units to the first positions when the pair of first protrusions of each of the developing units rest on the second part, a third part configured to fix a position of the cleaning member to the fourth position when the pair of second protrusions rest on the third part, and a fourth part configured to fix a position of the cleaning member to the third position when the pair of second protrusions rest on the fourth part.

31. The image-forming apparatus according to claim 30, wherein the each of the translation members is configured to move between a first location where the first protrusions rest on the second parts, respectively, and the second protrusions rest on the third part, and a second location where the first protrusions rest on the first parts, respectively, and the second protrusions rest on the fourth part.

32. The image-forming apparatus according to claim 19, wherein the conveying member is an endless belt having an upper moving section, and wherein the plurality of photosensitive bodies and the cleaning member, when in the third position, are configured to contact the upper moving section of the endless belt.

* * * * *